US011096003B2

(12) United States Patent
Kleinhans

(10) Patent No.: US 11,096,003 B2
(45) Date of Patent: Aug. 17, 2021

(54) METHOD FOR DETERMINING A PHASE FILTER FOR A SYSTEM FOR GENERATING VIBRATIONS

(71) Applicant: Faurecia Clarion Electronics Europe, Paris (FR)

(72) Inventor: Grégory Olivier Kleinhans, Paris (FR)

(73) Assignee: Faurecia Clarion Electronics Europe, Paris (FR)

( * ) Notice: Subject to any disclaimer, the term of this patent is extended or adjusted under 35 U.S.C. 154(b) by 0 days.

(21) Appl. No.: 16/733,981

(22) Filed: Jan. 3, 2020

(65) Prior Publication Data

US 2020/0221241 A1 Jul. 9, 2020

(30) Foreign Application Priority Data

Jan. 3, 2019 (FR) ..... 1900039

(51) Int. Cl.

| | |
|---|---|
| ***H04R 3/00*** | (2006.01) |
| ***H04R 5/00*** | (2006.01) |
| ***H04S 7/00*** | (2006.01) |
| ***H04R 5/02*** | (2006.01) |
| ***H04R 5/04*** | (2006.01) |
| ***H04S 1/00*** | (2006.01) |
| *H04R 3/12* | (2006.01) |

(52) U.S. Cl.

CPC ..... *H04S 7/302* (2013.01); *H04R 5/02* (2013.01); *H04R 5/04* (2013.01); *H04S 1/002* (2013.01); *H04R 3/12* (2013.01); *H04R 2499/13* (2013.01)

(58) Field of Classification Search

CPC . H04R 3/00; H04R 3/005; H04R 3/04; H04R 3/12; H04R 5/00; H04R 5/02; H04R 5/04; H04R 2499/13; H04S 1/00; H04S 1/002; H04S 5/00; H04S 7/00; H04S 7/30; H04S 7/302

See application file for complete search history.

(56) References Cited

U.S. PATENT DOCUMENTS

| | | | | |
|---|---|---|---|---|
| 4,739,513 A * | 4/1988 | Kunugi | ..... | H03G 5/165 381/103 |
| 5,033,092 A | 7/1991 | Sadaie | | |
| 5,095,507 A * | 3/1992 | Lowe | ..... | H04S 5/00 381/17 |

(Continued)

FOREIGN PATENT DOCUMENTS

FR 2865096 A1 7/2005

*Primary Examiner* — Thang V Tran

(74) *Attorney, Agent, or Firm* — Reising Ethington P.C.

(57) ABSTRACT

A determining method that makes it possible to determine a phase filter for a system that generates vibrations and that includes a first transducer for converting a first electrical signal and a second transducer for converting a second electrical signal. The method includes: performing, for at least one perception position, of a plurality of spectral measurements of a characteristic parameter of the vibrations generated in this perception position as a function of the frequency, each spectral measurement being done for a respective phase shift value between the first electrical signal and the second electrical signal; and determining a phase filter from spectral measurements done, by selecting, for each frequency, a phase shift value from among the phase shift values used to perform the spectral measurements.

20 Claims, 16 Drawing Sheets

(56) References Cited

U.S. PATENT DOCUMENTS

| | | | | |
|---|---|---|---|---|
| 5,208,860 | A * | 5/1993 | Lowe | H04S 1/002 381/17 |
| 2004/0170281 | A1* | 9/2004 | Nelson | H04R 5/02 381/17 |
| 2005/0213786 | A1 | 9/2005 | Kerneis | |
| 2006/0050896 | A1* | 3/2006 | Sung | H04R 3/14 381/97 |
| 2017/0070839 | A1* | 3/2017 | Mihelich | H04R 3/12 |
| 2019/0009717 | A1* | 1/2019 | Nagasawa | H04R 1/403 |
| 2019/0295524 | A1* | 9/2019 | Enamito | G10K 11/17853 |

* cited by examiner

METHOD FOR DETERMINING A PHASE FILTER FOR A SYSTEM FOR GENERATING VIBRATIONS

TECHNICAL FIELD

The present invention relates to the field of generating vibrations perceptible by a user for a multichannel vibration generating system.

BACKGROUND

"Multichannel" means that vibrations are generated at distinct points by distinct transducers from respective electrical signals received by the transducers, the vibrations generated by the different transducers being perceptible by a user at the same perception point.

One example of generating vibrations perceptible by a user is the reproduction of sounds (that is to say, vibrations of a gas, in particular air, perceptible by the user's hearing) using a stereophonic system, that is to say, a sound reproduction system with two channels, each channel supplying a respective electrical audio signal, and at least one pair of electroacoustic transducers (or speakers), the two electroacoustic transducers of which each respectively receive one of the two electrical audio signals, in order to reproduce a sound image with a spatial rendering, that is to say, a reconstitution of the spatial distribution of the sound sources.

When a listener is located equidistant from the two electroacoustic transducers, the listener perceives the sounds emitted by both electroacoustic transducers at the same time, which allows the listener to perceive the spatial rendering.

However, the listener is generally not located equidistant from the two electroacoustic transducers.

This is for example the case in motor vehicles, in which the two electroacoustic transducers are generally located on either side of the motor vehicle, the seats being offset laterally relative to the central longitudinal axis of the vehicle and each passenger therefore being closer to one electroacoustic transducer than to the other electroacoustic transducer.

As a result, the sounds produced by the two electroacoustic transducers reach the listener with a time shift between the sounds produced by one electroacoustic transducer and the sounds produced by the other electroacoustic transducer.

This causes a phase shift of the sounds produced by the electroacoustic transducers and reaching the listener located in the off-centered listening position, this phase shift depending on the frequency.

This phase shift can generate unwanted effects that are perceptible by the listener.

To avoid or limit these unwanted effects, one possible solution is to delay the signals sent to the electroacoustic transducer as close as possible to the listener, so that the sounds generated by the two electroacoustic transducers reach the listener substantially in phase.

However, the application of a simple delay is not always satisfactory. Furthermore, when several distinct listening positions exist, as is for example the case in a motor vehicle, the application of a delay can improve listening in one listening position but deteriorate listening in another listening position.

U.S. Pat. No. 5,033,092A1 discloses the application of a phase shift P with two channels of a stereophonic system by distributing the phase shift P between the two channels, that is to say, by applying a phase shift P/2 to one channel and a phase shift −P/2 to the other channel.

FR2865096A1 discloses the determination of a phase filter of the "Head Relative Transfer Function" (HRTF) type from measurements done in situ in a vehicle.

SUMMARY

One of the aims of the invention is to propose a method for determining a phase filter for a system for generating vibrations with several transducers, the phase filter making it possible to improve the perception of the vibrations.

To that end, the invention proposes a method for determining a phase filter for a system for generating vibrations perceptible by a user comprising a signal source configured to deliver a first electrical signal and a second electrical signal, and a pair of transducers comprising a first transducer for converting the first electrical signal into vibrations perceptible by a user and a second transducer for converting the second electrical signal into vibrations perceptible by a user, the phase filter being provided to introduce a relative phase shift between the first electrical signal and the second electrical signal, the method comprising:

- performing, for at least one determined perception position, of a plurality of spectral measurements of a characteristic parameter of the vibrations generated in this perception position as a function of the frequency, each spectral measurement being done for a respective phase shift value between the first electrical signal and the second electrical signal, and
- determining a phase filter from spectral measurements done, by selecting, for each frequency, a phase shift value from among the phase shift values used to perform the spectral measurements.

The performance of spectral measurements of a characteristic parameter of the vibrations for several phase shift values makes it possible to determine a phase filter by selecting, for each frequency, a phase shift value from among the phase shift values used to perform the measurement, as a function of the results of the spectral measurements. This for example makes it possible to improve the spatial rendering of the sound image reproduced by a stereophonic system and perceived by the listeners.

According to specific embodiments, the method for determining a phase filter comprises one or more of the following optional features, considered individually or according to any technically possible combination(s):

- the step for performing spectral measurements comprises performing exactly two spectral measurements;
- the phase shift values used for the two spectral measurements are 0 and $\pi$;
- the determining method comprises performing spectral measurements for two distinct perception positions and determining values assumed by the phase filter as a function of the frequency according to one or several of the following criteria: the value $\pi$ for each frequency for which a phase shift of $\pi$ causes an increase of the characteristic parameter for each perception position; the value 0 for each frequency for which a phase shift of $\pi$ causes a decrease of the characteristic parameter for each perception position; the value $\pi$ for each frequency for which a phase shift of $\pi$ causes an increase of the characteristic parameter for one perception position without modifying the characteristic parameter for the other perception position significantly; and/or the value $\pi$ for each frequency for which a phase shift of $\pi$ causes, for a perception position, an increase above an increase threshold, for example +3 dB, of the characteristic parameter while causing, for the other perception position, a decrease below a decrease threshold, for example −3 dB, of the characteristic parameter;

the determining method performing spectral measurements for two distinct perception positions and determining values assumed by the phase filter as a function of the frequency according to one or several of the following criteria: the value π for each frequency for which a phase shift of n causes a decrease of the characteristic parameter for each perception position; the value 0 for each frequency for which a phase shift of π causes an increase of the characteristic parameter for each perception position; the value π for each frequency for which a phase shift of π causes a decrease of the characteristic parameter for one perception position without modifying the characteristic parameter for the other perception position significantly; and/or the value π for each frequency for which a phase shift of π causes, for a perception position, a decrease above a decrease threshold, for example −3 dB, of the characteristic parameter while causing, for the other perception position, an increase below an increase threshold, for example +3 dB, of the characteristic parameter;

the value of the phase difference between two transducers is chosen to be equal to the value of +π/2 or −π/2 for each frequency for which none of the aforementioned criteria are applicable;

the phase filter is determined by taking a phase shift of π for the frequencies for which a phase shift of π causes an increase, respectively a decrease, of the characteristic parameter, a nil phase shift for the frequencies for which a phase shift of π causes a decrease, respectively an increase, of the characteristic parameter, and a nil phase shift for the other frequencies;

the spectral measurements are done for each perception position with a series of phase shift values with a regular interval between the phase shift values;

the spectral measurements are done successively by varying the phase shift incrementally between the successive spectral measurements;

the step for performing spectral measurements comprises performing N measurements for each perception position, with an interval of 2π/N between the phase shift values, N being a real number;

the determination of the phase filter comprises the determination of the first phase filter, and the unwrapping and/or smoothening of the first phase filter;

the step for performing spectral measurements comprises performing spectral measurements for several distinct perception positions, and the step for determining the phase filter comprises determining a phase filter as an average of phase filters associated with the different perception positions;

the step for performing spectral measurements comprises performing spectral measurements for several distinct perception positions, and the determining step comprises determining a phase filter from the average of the spectral measurements associated with the different perception positions;

the characteristic parameter is the amplitude of the vibrations;

the vibrations are sound vibrations, the first transducer and the second transducer being electroacoustic transducers; and the vibrations are mechanical vibrations of a solid that are perceptible to the touch and/or capable of generating acoustic waves due to the vibrations of the solid.

The invention also relates to a method for generating vibrations that are perceptible by a user using a system for generating vibrations comprising a source of electrical signals in order to supply a first electrical signal and a second electrical signal, a filtering module configured for the relative phase shift of the first electrical signal and the second electrical signal by implementing a phase filter determined according to a determining method as defined above, and generating vibrations via at least one pair of transducers comprising a first transducer and a second transducer respectively converting the first electrical signal and the second electrical signal, phase-shifted relative to one another by the filtering module, into vibrations.

The invention also relates to a method for reproducing sounds using a stereophonic system comprising a signal source configured to supply a first audio signal and a second audio signal, a filtering module configured for the relative phase shift of the first audio signal and the second audio signal by implementing a phase filter determined according to a determining method as defined above, and the broadcasting of the first audio signal and the second audio signal filtered by the phase filter via a broadcasting assembly comprising at least one pair of electroacoustic transducers comprising a first electroacoustic transducer and a second electroacoustic transducer respectively broadcasting the first audio signal and the second audio signal phase-shifted relative to one another by the filtering module.

The invention further relates to a filtering module for a vibration-generating system, in particular a stereophonic system, the filtering module being configured to implement a phase filter obtained by a determining method as defined above.

The invention also relates to a system for generating vibrations comprising a source of electrical signals in order to supply a first electrical signal and a second electrical signal, a filtering module configured to implement a phase filter determined according to a determining method as defined above, and configured to introduce a relative phase shift between the first audio signal and the second audio signal, and at least one pair of transducers comprising a first transducer and a second transducer respectively receiving the first electrical signal and the second electrical signal, phase-shifted relative to one another by the phase filter.

The invention also relates to a stereophonic system comprising a signal source configured to supply a first electrical audio signal and a second electrical audio signal, a filtering module configured for the relative phase shift of the first audio signal and the second audio signal by implementing a phase filter determined according to a determining method as defined above, and the broadcasting of the first audio signal and the second audio signal filtered by filtering module via a broadcasting assembly comprising at least one pair of electroacoustic transducers comprising a first electroacoustic transducer and a second electroacoustic transducer respectively broadcasting the first audio signal and the second audio signal phase-shifted relative to one another by the filtering module.

BRIEF DESCRIPTION OF THE DRAWINGS

The invention and its advantages will be better understood upon reading the following description, provided solely as a non-limiting example, and done in reference to the appended drawings, in which.

DETAILED DESCRIPTION

The invention generally relates to generating vibrations that are perceptible by a user using a system for generating vibrations that is configured for the separate generation of vibrations simultaneously from several distinct electrical signals, each electrical signal being converted into vibrations by a respective transducer.

The generated vibrations are for example acoustic vibrations (or sounds) that are perceptible by the hearing of a user, or mechanical vibrations of a solid that are perceptible to the touch by a user.

A system for generating vibrations is for example a stereophonic system that is configured to generate sounds perceptible by a user.

An exemplary embodiment applied to a stereophonic system will now be described in order to illustrate the invention.

Figure 1:
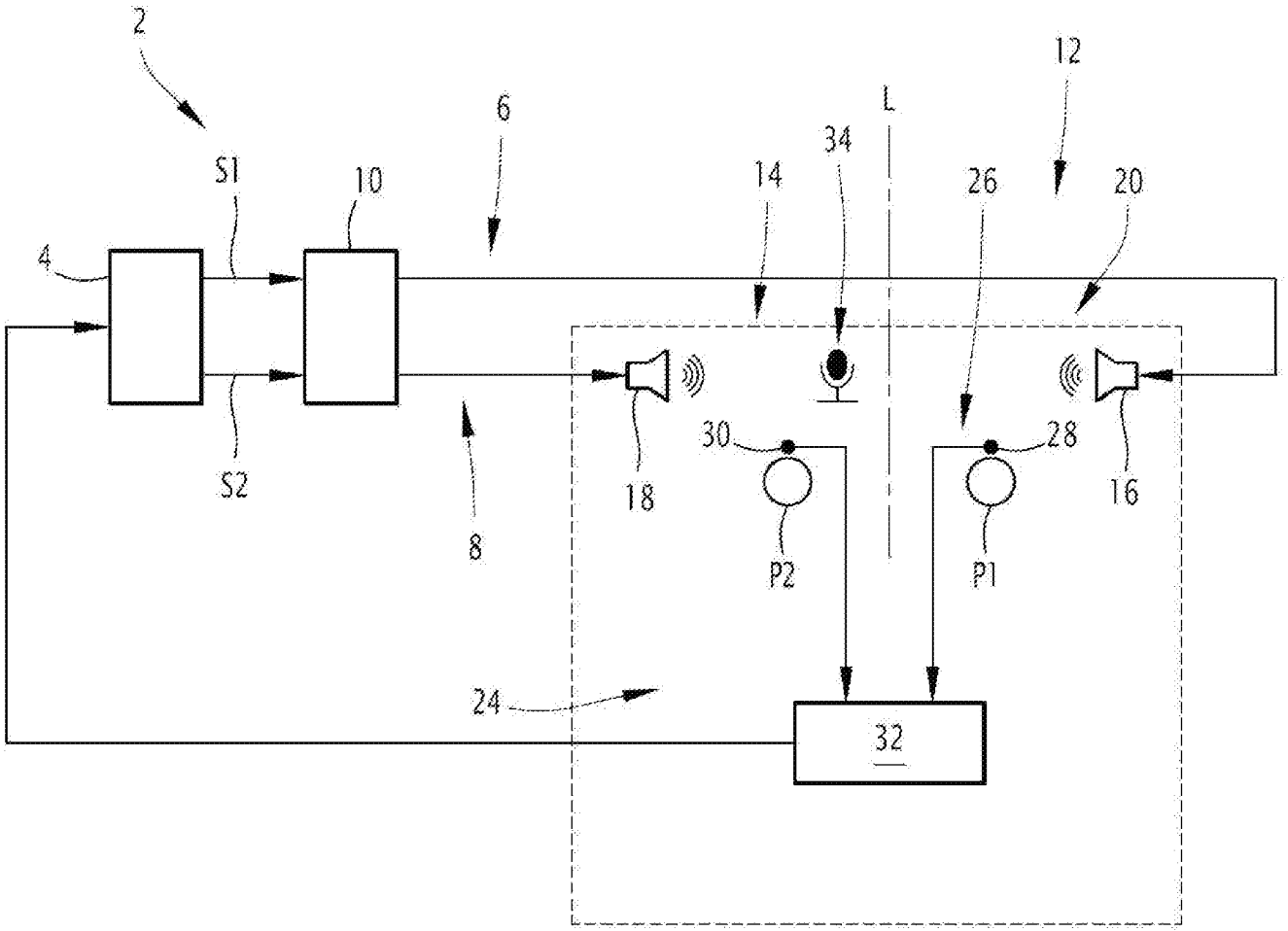
FIG. 1 is a schematic view of a stereophonic system for reproducing sounds and an assembly for determining a phase filter of the stereophonic system.

The stereophonic system 2 illustrated in FIG. 1 comprises an electrical signal source 4 that is configured in order to supply a first audio signal S1 to a first channel 6 and a second audio signal S2 to a second channel 8, from an audio file or an audio stream.

An electrical audio signal is an electrical signal representative of sounds and able to be converted into sounds by an electroacoustic transducer.

An audio file is for example recorded on a data medium (computer memory, CD-ROM, etc.). The audio file is for example read by the audio source 4.

An audio stream is for example received by the audio source 4 by means of a communication network, for example the Internet or a wireless telecommunications network. The generation of audio signals from an audio stream is generally called streaming.

The first channel 6 and the second channel 8 of the stereophonic system 2 are configured to transmit audio signals S1, S2 to electroacoustic transducers provided to convert these audio signals S1, S2 into sounds.

The stereophonic system 2 comprises a filtering module configured to filter the first audio signal S1 and/or the second audio signal S2 so as to phase shift them relative to one another, the relative phase shift introduced between the first audio signal S1 and the second audio signal S2 depending on the frequency, in order to improve the sound reproduction broadcast by the stereophonic system 2.

The filtering module 10 is arranged on the first channel 6 and/or the second channel 8 in order to filter the first audio signal S1 and/or the second audio signal S2 in order to introduce a phase shift of one relative to the other, the relative phase shift being a function of the frequency.

The stereophonic system 2 comprises a broadcast assembly 12 comprising at least one pair of electroacoustic transducers 14, each pair of electroacoustic transducers 14-speakers comprising a first electroacoustic transducer 16 connected to the first channel 6 for the conversion of the first audio signal S1 into sounds and a second electroacoustic transducer 18 connected to the second channel 8 in order to convert the second audio signal S2 into sounds.

The first electroacoustic transducer 16 and the second electroacoustic transducer 18 respectively receive the first audio signal S1 and the second audio signal S2 after phase shifting by the filtering module 10.

The stereophonic system 2 is associated with at least one listening position P1, P2 that is off-centered (or offset) relative to a central line L, each point of which is equidistant from the first electroacoustic transducer 16 and the second electroacoustic transducer 18 of the pair of electroacoustic transducers 14.

Each off-centered listening position P1, P2 is closer to one of the first electroacoustic transducer 16 and the second electroacoustic transducer 18 than the other.

The stereophonic system 2 is for example located in a motor vehicle 20, the first electroacoustic transducer 16 and the second electroacoustic transducer 18 of each pair of electroacoustic transducers 14 being located on either side of the vehicle 20, one listening position P1 for example corresponding to the driver's seat and the other listening position P2 for example corresponding to the front passenger's seat.

A determining assembly 24 of a phase filter comprises a measuring device 26 configured to measure the sounds perceived in at least one listening position, for example in the listening position P1 or in each of the two listening positions P1, P2.

The measuring device 26 comprises at least one sound sensor 28, 30, for example a microphone, and a determining module 32 configured to determine a phase filter from measuring signals supplied by each sound sensor 28, 30 during the reproduction of sounds by the stereophonic system 2.

The measuring device 26 is configured to perform the spectral measurements in situ, that is to say, in the usage configuration of the stereophonic system 2, here in the vehicle 20 with the inner layout of the vehicle (dashboard, center console, inner roof, seats, door trim, etc.).

The measuring device 26 is configured to take spectral measurements of the acoustic pressure in each considered listening position P1, P2.

A spectral measurement of the acoustic pressure consists of emitting a sound and measuring the acoustic pressure in each considered listening position P1, P2 as a function of the frequency. The term "spectral" means that the acoustic pressure is determined for each frequency.

In particular, the determining module 32 is configured to analyze the measurement signals supplied by each sound sensor 28, 30 during the broadcasting of a sound to extract a spectral measurement therefrom.

Optionally, the determining module 32 is configured to supply the source 4 with the audio files or the audio streams for the audio signals to be reproduced during the method for determining the transfer function of the phase filter 10.

The audio signals used to perform the spectral measurements of the acoustic pressure are preferably broadband signals, that is to say, signals containing frequencies over an extended frequency band, for example pink noise. Pink noise is a random signal whose spectral density is constant by octave band.

In one exemplary embodiment, the audio signals used are obtained from a same mono signal, with a relative phase shift application between the two channels 6, 8.

The determining assembly 24 makes it possible to implement a method for determining a phase filter able to be implemented by the filtering module 10 with the aim of improving the spatial rendering of sound recordings reproduced by the stereophonic system 2 during the use of the latter.

The method for determining a phase filter comprises a step for performing, for at least one determined listening position P1, P2, a plurality of spectral measurements, by sending a first audio signal S1 to the first electroacoustic transducer 16 and a second audio signal S2 to the second electroacoustic transducer 18, one of the first audio signal S1 and the second audio signal S2 being obtained by phase shifting the other S1 or corresponding to the phase-shifted first audio signal, each spectral measurement being done for a respective phase shift between the first audio signal S1 and the second audio signal S2.

During each spectral measurement, the phase shift between the first audio signal S1 and the second audio signal S2 is predetermined. This may involve the same phase shift applied to all of the frequencies or a phase shift that is a function of the frequency.

The relative phase shift can be obtained by applying a phase shift to only one among the first audio signal S1 and the second audio signal S2 or by distributing the phase shift among the first audio signal S1 and the second audio signal S2.

At least one of the spectral measurements is done with a non-nil phase shift.

The step for performing spectral measurements is done with a phase for calibrating the stereophonic system 2, in which the phase filter of the filtering module 10 is not yet determined.

The determining method comprises determining a phase filter as a function of the spectral measurements done in the step for performing spectral measurements, by selecting, for each frequency, a phase shift value from among the phase shift values used to perform the spectral measurements.

Thus, the spectral measurements done for several phase shift values make it possible to select, for each frequency, among the phase shift values used, the most appropriate phase shift value.

The spectral measurements are done in situ. This means that the spectral measurements are done by using the stereophonic system 2 in order to generate sounds, the stereophonic system 2 being in its usage environment, and in its usage configuration, with the exception of the filtering module 10, the phase filter of which is not yet determined.

The in situ spectral measurements make it possible to account for the environment in which the cells are broadcast, this environment influencing the propagation of the sound and therefore the spatial rendering for each listening position.

This influence is in particular related to the reflections of the sound on the surfaces of the environment, for example here on the surfaces of the passenger compartment of the motor vehicle.

It is possible to implement the determining method to improve the spatial rendering by using exactly two different phase shift values to perform the spectral measurements, in particular a nil phase shift and a phase shift of $\pi$, or at least three different phase shift values.

The determination of a phase filter suitable for a listening position, here the listening position P1, with two phase shift values is described hereinafter in reference to FIGS. 2 to 5.

Figure 2:
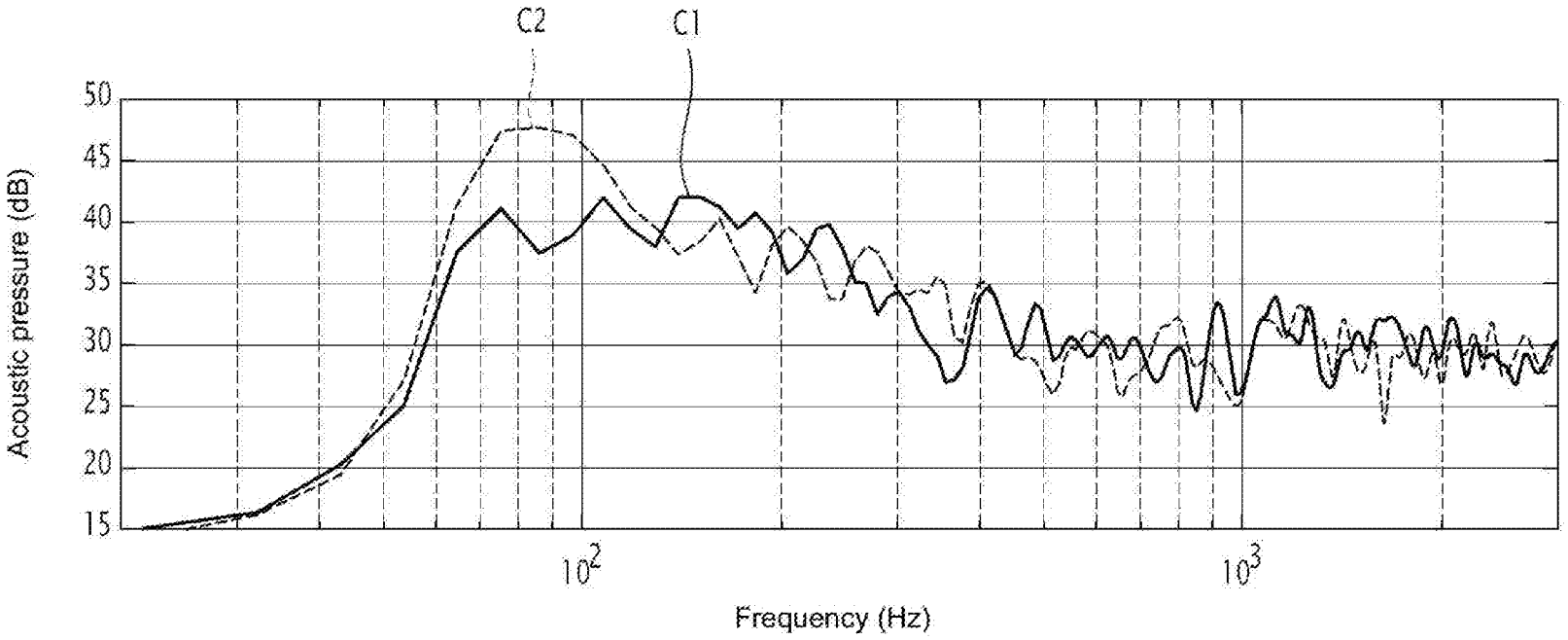
FIG. 2 shows a graph illustrating two acoustic pressure spectral measurements as a function of the frequency, done in a listening position and for two different phase shift values between the two audio signals generated by the stereophonic system.

FIG. 2 is a graph showing the frequency on the x-axis and the acoustic pressure (or sound amplitude) on the y-axis, and showing two curves, namely a first curve C1 showing a spectral measurement done in the listening position P1 for a nil phase shift and a second curve C2 showing a spectral measurement done in the listening position P1 for a phase shift of $\pi$. A phase shift of $\pi$ is also called "phase opposition".

As shown in FIG. 2, the phase shift supplying the highest acoustic pressure for the listening position P1 varies as a function of the frequency.

In FIG. 2, this corresponds to the fact that for certain frequencies, the first curve C1 is above the second curve C2 (the nil phase shift supplies a higher acoustic pressure than the phase shift of $\pi$ for these frequencies) and that for other frequencies, the second curve C2 is above the first curve C1 (the phase shift of $\pi$ supplies a higher acoustic frequency than the nil phase for these frequencies).

Figure 3:
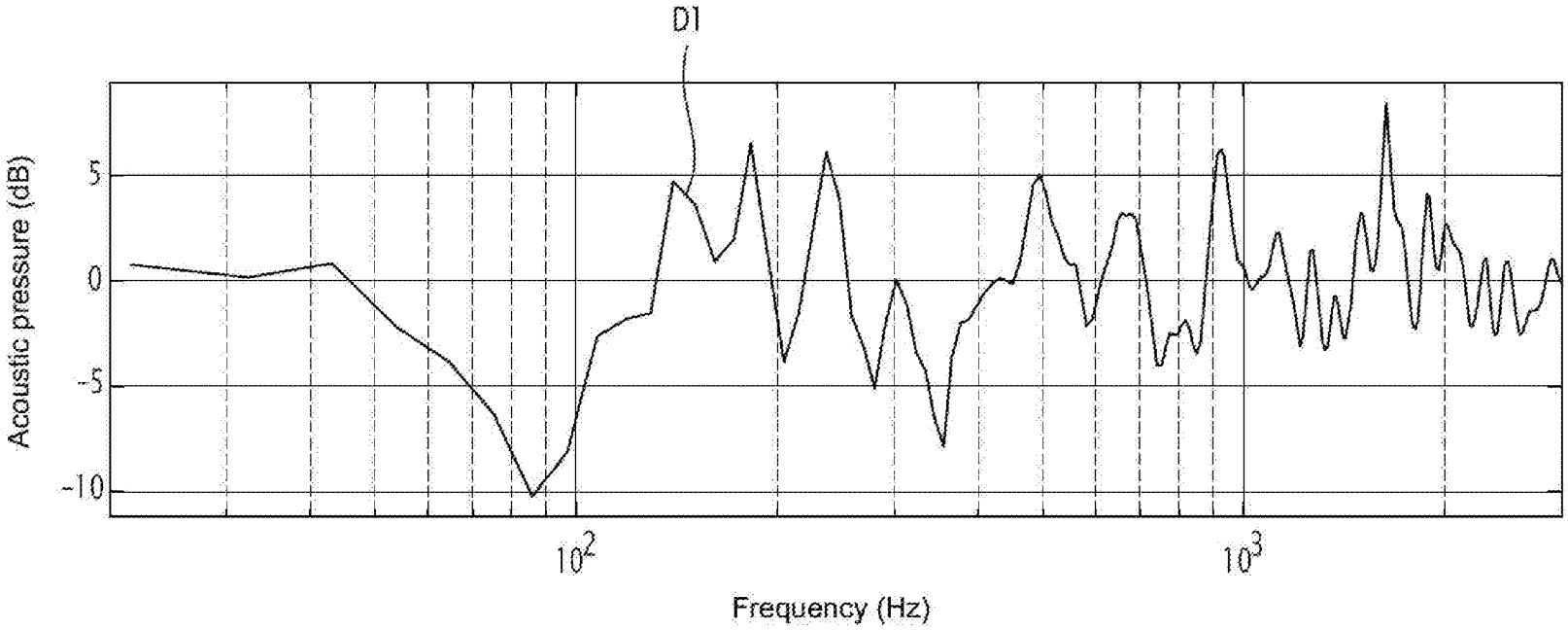
FIG. 3 is a graph illustrating the acoustic pressure variation in phase opposition as a function of the frequency, determined by difference between the two measurements illustrated in the graph of FIG. 2.

FIG. 3 is a graph showing the frequency on the x-axis and the acoustic pressure on the y-axis, and showing an acoustic pressure variation curve D1 corresponding to the difference between the second curve C2 and the first curve C1 of the graph of FIG. 2 for each frequency.

The acoustic pressure variation associated with the phase shift value represents the acoustic pressure variation for each frequency contributed by this phase shift value relative to a nil phase shift.

When the second curve C2 is located above the first curve C1, the differential curve D1 is located above zero, and when the second curve C2 is located below the first curve C1, the differential curve D1 is located below zero.

According to one example embodiment, the determining step comprises determining a phase filter so as to maximize the acoustic pressure for the considered listening position P1.

In other words, this means that the phase filter is determined by choosing, for each frequency, among the two phase shift values used to perform the spectral measurements, here namely the nil phase shift and the phase shift of 7C, the phase shift value that supplies the highest acoustic pressure.

Figure 4:
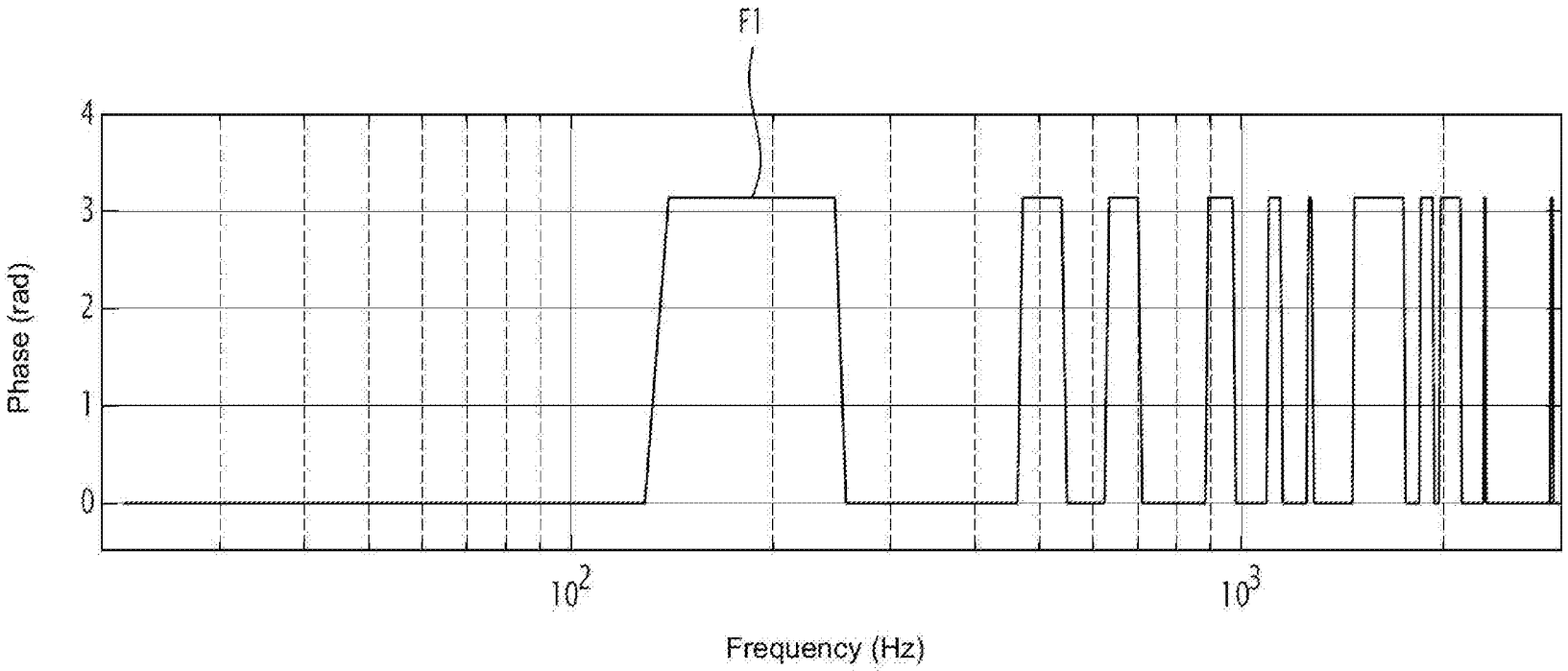
FIG. 4 is a graph illustrating a phase filter determined from measurements illustrated in the graph of FIG. 2.

FIG. 4 is a graph showing the frequency on the x-axis and the phase shift on the y-axis, and showing a phase filter F1 determined from measurements illustrated in FIG. 2, choosing, for each frequency, between the nil phase shift and the phase shift of 7C, that which maximizes the acoustic pressure in the listening position P1.

This phase filter F1 is usable by the filtering module 10 of the stereophonic system 2 during normal operation.

However, such a phase filter F1 has abrupt phase shift variations capable of generating artifacts capable of deteriorating the sound reproduction quality.

Preferably, the phase filter F1 is a first phase filter determined during the determining step, and the determining method comprises a step for smoothening the first phase filter F1, in order to obtain a second phase filter.

The smoothening makes it possible to limit the phase shift variations. The smoothening is for example a smoothening with octave thirds.

Figure 5:
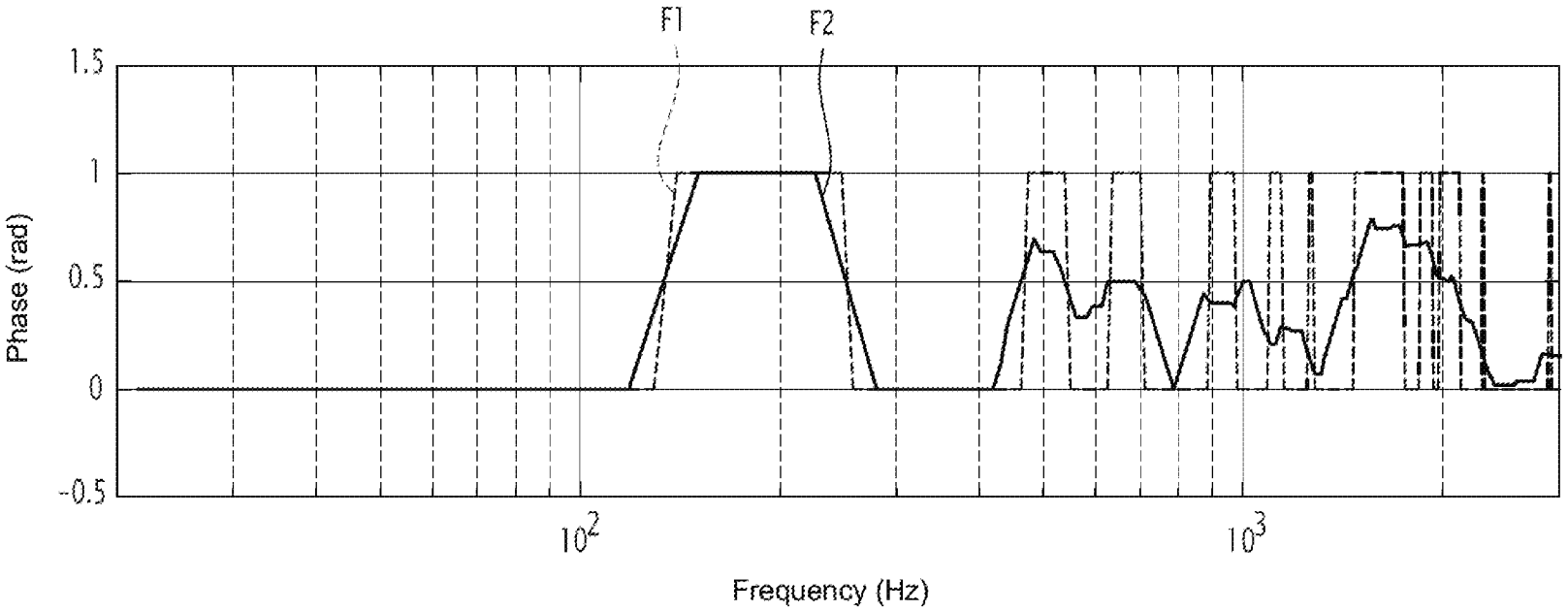
FIG. 5 is a graph illustrating a phase filter obtained by smoothening of the phase filter of FIG. 4.

FIG. 5 is a graph showing the frequency on the x-axis and the phase shift on the y-axis, and showing a second phase filter F2 resulting from the one-third octave smoothening of the first phase filter F1 of FIG. 4.

This second phase filter F2 is usable by the filtering module 10 of the stereophonic system 2 during normal operation.

The application of a determined phase filter in order to improve the reproduction of the sound in a listening position, here the listening position P1, is capable of deteriorating the reproduction of the sound for another listening position, here the listening position P2.

It is possible to determine a phase filter producing a compromise in order to improve the reproduction of the sound for both listening positions, here the listening positions P1 and P2.

The step for producing spectral measurements is performed for each of the two listening positions P1, P2.

Next, in one exemplary embodiment, the choice of the phase shift is determined for each frequency as a function of both the phase shift maximizing the acoustic pressure for each of the two listening positions P1, P2 and the acoustic pressure variation contributed by each phase shift for each of the two listening positions P1, P2.

For example, the choice of the phase shift for each frequency is made by applying one or several criteria chosen from among the following criteria:

- the value π for each frequency for which a phase shift of n causes an increase of the sound pressure for each listening position (P1, P2) (criterion no. 1);
- the value 0 for each frequency for which a phase shift of π causes a decrease of the sound pressure for each listening position (P1, P2) (criterion no. 2);
- the value π for each frequency for which a phase shift of n causes an increase of the sound pressure for one listening position without modifying the sound pressure for the other listening position substantially (criterion no. 3); and/or
- the value π for each frequency for which a phase shift of n causes an increase of the sound pressure for one listening position above an increase threshold, for example 3 dB, while causing a decrease of the sound pressure for the other listening position below a decrease threshold, for example −3 dB (criterion no. 4).

It is possible to apply only one of the four criteria described above or several of the four criteria described above in combination, in particular two or three criteria from among the four criteria described above or all four of the criteria described above.

In one preferred embodiment, the step for determining the phase filter comprises the application of criteria no. 1 and no. 2, and additionally the application of criterion no. 3.

In criterion no. 4, the predetermined threshold is for example a threshold of −3 dB, which corresponds to a division by two of the acoustic pressure.

In criterion no. 3, the expression "without significantly decreasing" means that the acoustic pressure variation is small enough to be difficult to perceive. For example, the acoustic pressure decrease is below 1 dB.

Optionally, for each frequency for which none of the aforementioned criteria are met, a phase shift of +n/2 or of −π/2 between the audio signals of S1 and S2 may be studied in order to find a satisfactory compromise.

This case corresponds to a frequency for which a phase shift of 7C increases the acoustic pressure to one from among the two listing positions P1, P2 and decreases the acoustic pressure to the other from among the two listening positions P1, P2 significantly or past the predetermined threshold.

In a variant, the phase filter is chosen as not applying any phase shift.

The determination of a phase filter suitable for a listening position, here the listening position P1, with three or more phase shift values is described hereinafter in reference to FIGS. 6 to 14.

The determining method is carried out with a number N of different phase shift values used to perform the acoustic pressure spectral measurements, N being a real number, for example an integer.

Preferably, the phase shift values define a series of N phase shift values with a regular interval or increment between the consecutive phase shift values of the series.

Preferably, one of the phase shift values is 0.

The determining method for example comprises performing N acoustic pressure spectral measurements with a series of N phase shift values of between −π and +π, each phase shift value of the series being obtained by adding an increment of π/N to the previous phase shift value.

In one exemplary embodiment, the phase shift values are: [−π; −(N−1) π/N; . . . −π/N; 0; π/N; . . . (N−1)π/N]. In another exemplary embodiment, the phase shift values are: [−(N−1)π/N; . . . −/N; 0; π/N; . . . (N−1)π/N; π].

The spectral measurements are for example done successively with the phase shift values, in the increasing or decreasing direction. In other words, the spectral measurements are done from the phase shift value −π and by increasing the phase shift value by an increment of π/N between each spectral measurement and the next one, until reaching the phase shift value +π or conversely from the phase shift value+π and decreasing the phase shift value by an increment of π/N between each spectral measurement and the next one, until reaching the phase shift value −π.

Of course, it is possible to perform the spectral measurements in a different order, this having no impact on the result of the determination of the phase filter.

Figure 6:
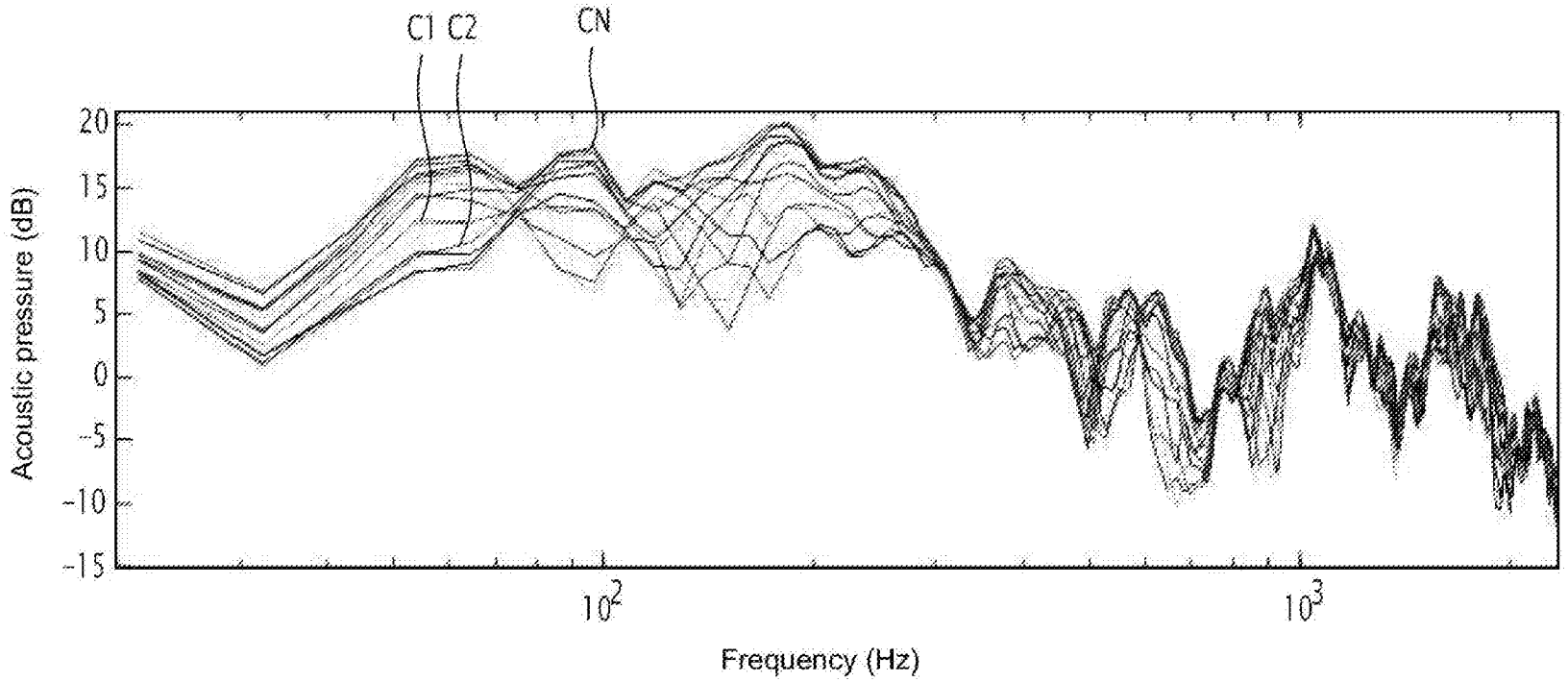
FIG. 6 is a graph illustrating acoustic pressure spectral measurements as a function of the frequency, done in a listening position and for a plurality of different phase shift values.

FIG. 6 is a graph showing the frequency on the x-axis and the acoustic pressure on the y-axis, and on which curves C1, C2 . . . CN are shown, each curve C1, C2 . . . CN showing a spectral measurement done in the listening position P1 for a respective phase shift value among the series of phase shift values.

Figure 7:
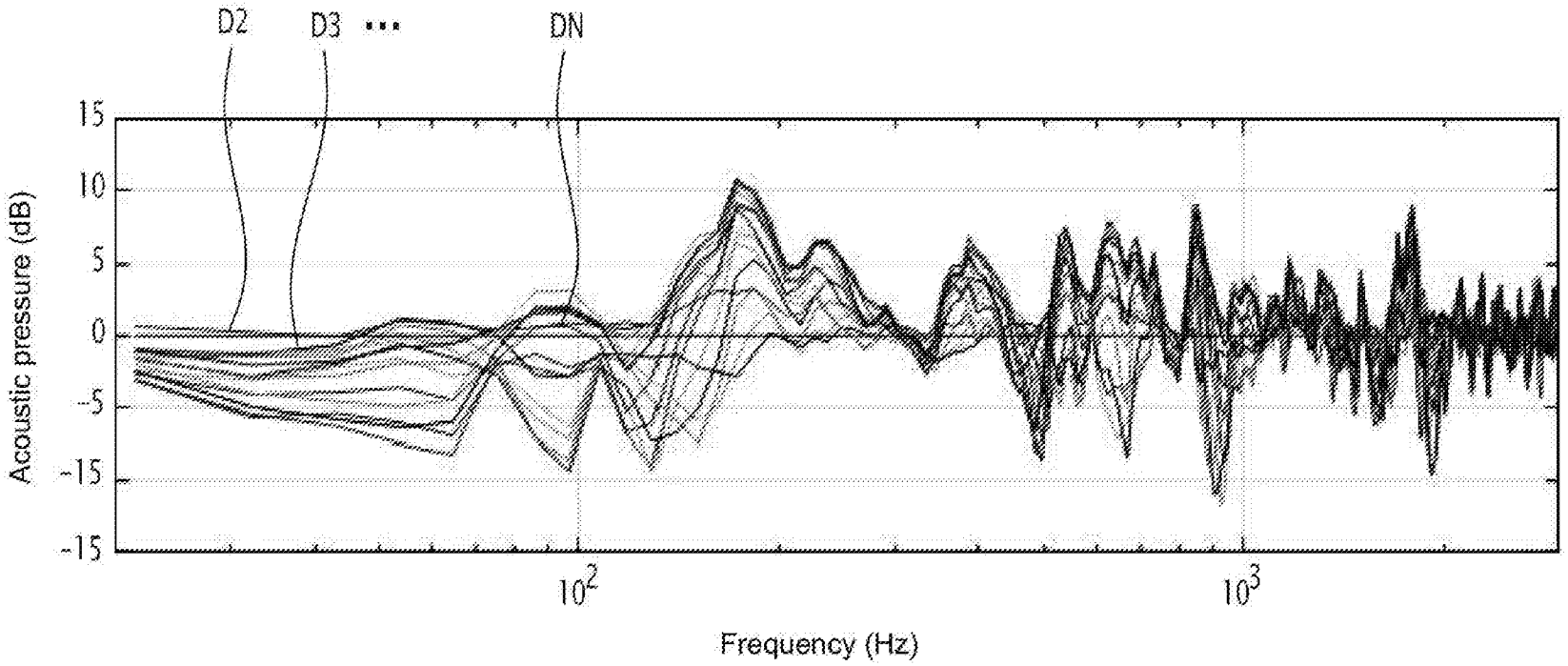
FIG. 7 is a graph illustrating the acoustic pressure variation as a function of the frequency and relative to a nil phase shift, for each non-nil phase shift value, each acoustic pressure variation being determined from curves of the graph of FIG. 6.

FIG. 7 is a graph showing the frequency on the x-axis and the acoustic pressure on the y-axis, and showing variation curves D2, D3 . . . DN, each variation curve D2, D3 . . . DN representing the difference between the spectral measurement performed for a non-nil phase shift value and the spectral measurement done for the nil phase shift value.

According to an exemplary embodiment, the determining step of the phase filter comprises the selection, for each frequency and among the phase shift values used to perform the spectral measurements, of the phase shift value causing the strongest acoustic pressure at the considered listening point, here the listening point P1.

Figure 8:
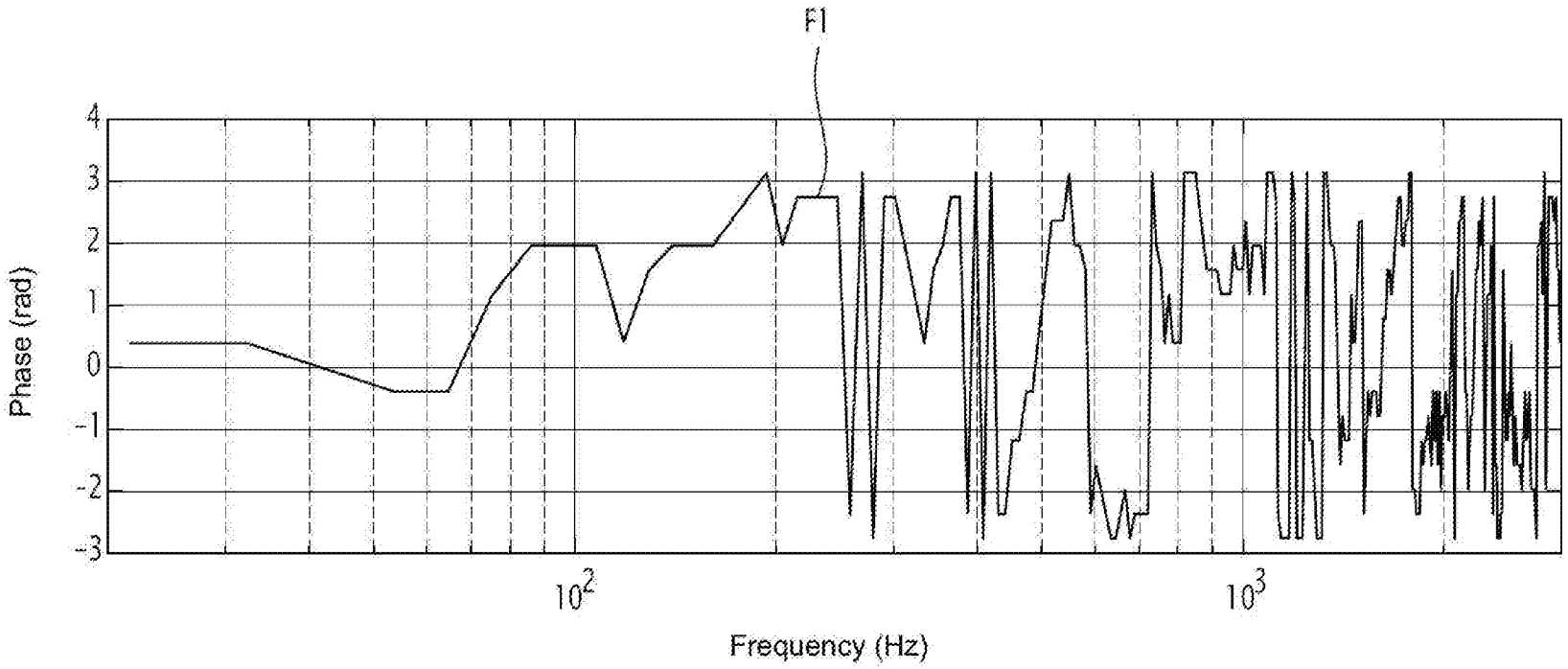
FIG. 8 is a graph illustrating a phase filter determined from measurements illustrated in the graph of FIG. 6.

FIG. 8 is a graph showing the frequency on the x-axis and the phase shift on the y-axis, and showing the second phase filter F1 thus obtained.

This phase filter F1 is usable in the stereophonic system 2, more particularly in the filtering module 10.

However, such a phase filter causes significant phase shift hops on all of the frequencies, which can cause artifacts capable of damaging the sound reproduction done by the stereophonic system 2.

According to one exemplary embodiment, the determining method comprises determining a first phase filter, here the phase filter F1, and the unwrapping of the first phase filter F1 and/or the smoothening of the first phase filter F1 in order to obtain a phase filter suitable for being implemented in the filtering module 10 of the stereophonic system 2.

The unwrapping operation is known in itself and consists of exploiting the fact that the phase shift is expressed modulo $2\pi$, that is to say, a phase shift value X is equivalent to a phase shift value $X+M\times 2\pi$, M being a natural integer.

The unwrapping operation comprises modifying the transfer function to replace one value with another equivalent value to prevent any hop above a predetermined hop threshold, for example equal to $\pi$.

Figure 9:
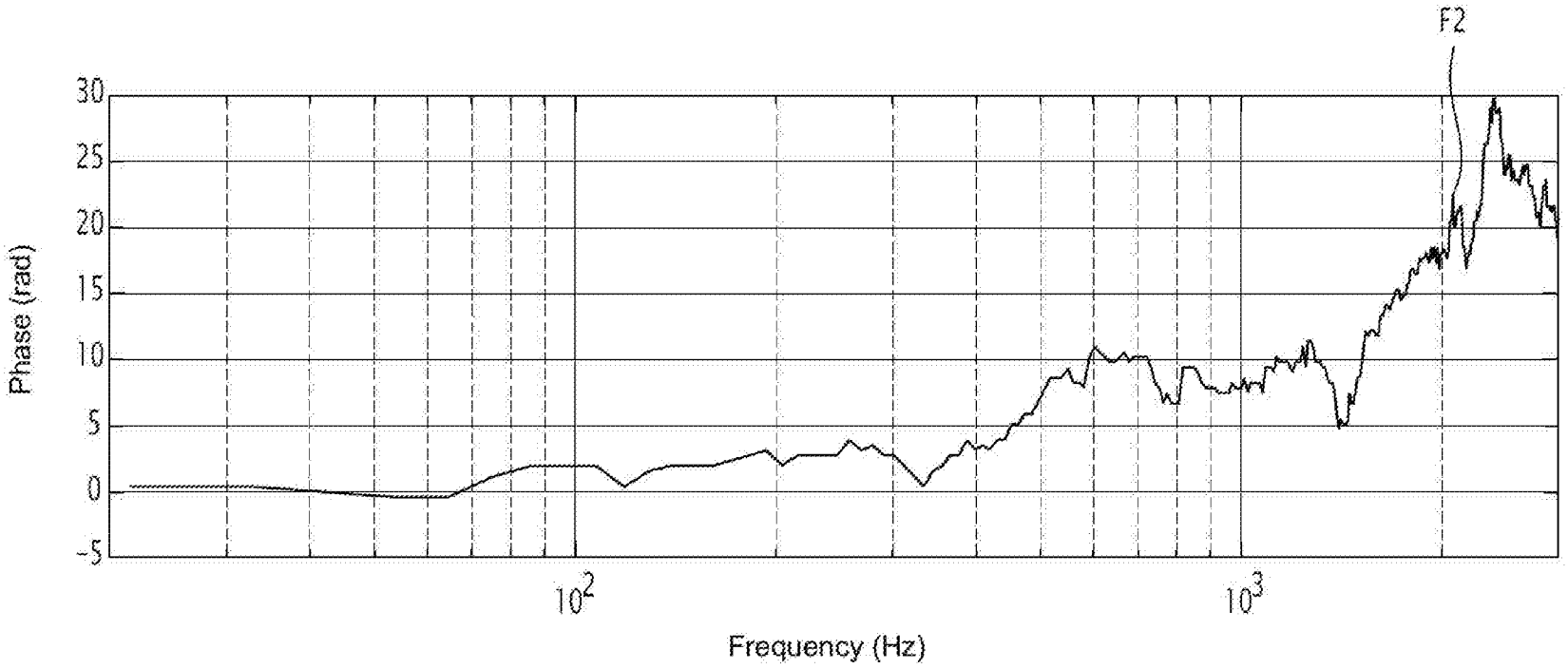
FIG. 9 is a graph illustrating a phase filter obtained by unwrapping of the phase filter of FIG. 8.

FIG. 9 is a graph showing the frequency on the x-axis and the phase shift on the y-axis, and showing a second phase filter F2 obtained by unwrapping the first phase filter F1 of FIG. 8.

This second phase filter F2 is usable as phase filter in the filtering module 10.

Figure 10:
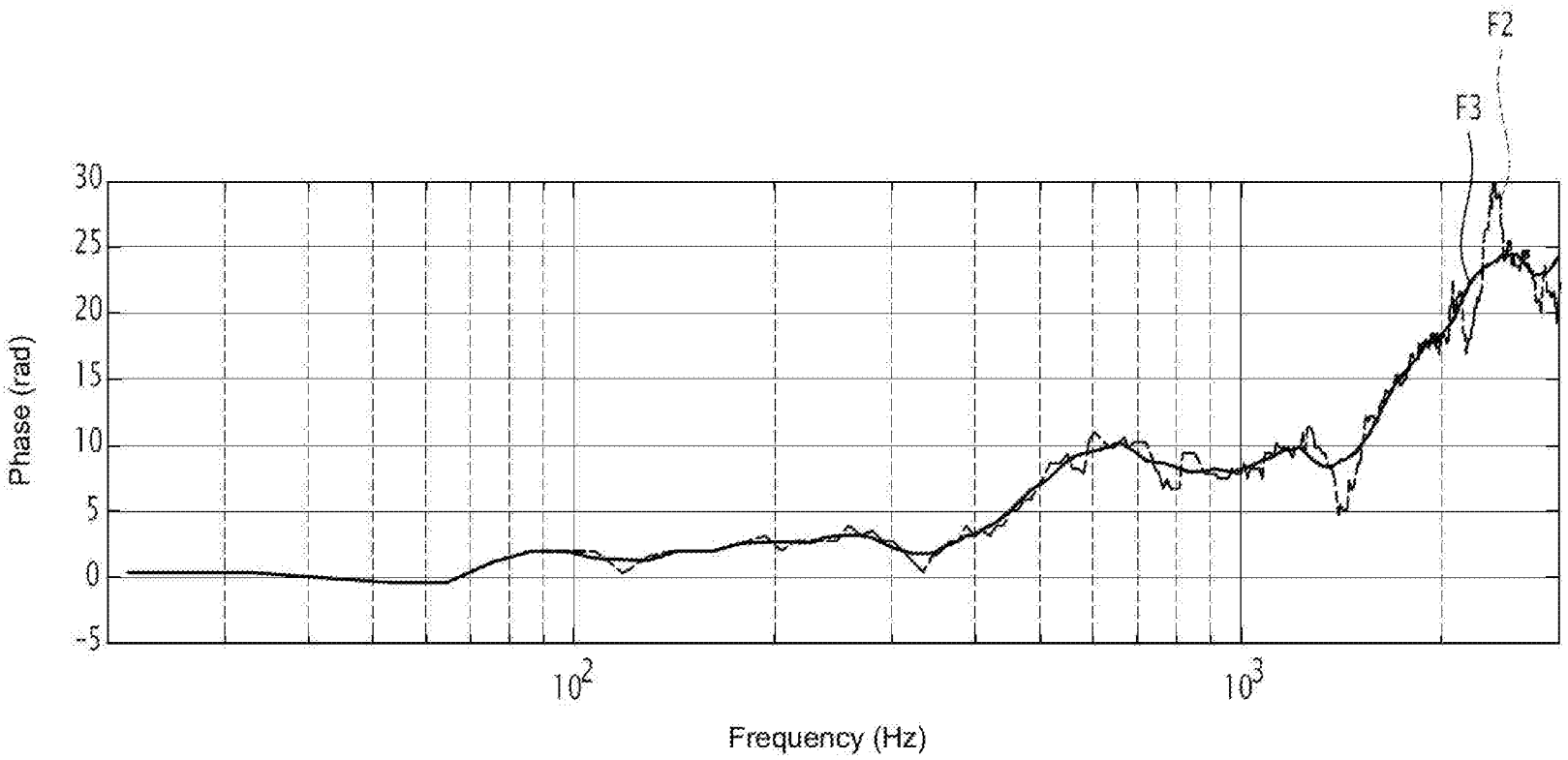
FIG. 10 is a graph illustrating a phase filter obtained by smoothening of the phase filter of FIG. 9.

FIG. 10 is a graph showing the frequency on the x-axis and the phase shift on the y-axis, and showing a third phase filter F3 obtained by smoothening the second phase filter F2 of FIG. 9.

This third phase filter F3 is usable as phase filter in the filtering module 10.

The application of a determined phase filter in order to improve the reproduction of the sound in a listening position, here the listening position P1, is capable of deteriorating the reproduction of the sound for another listening position, here the listening position P2.

It is possible to determine a phase filter producing a satisfactory compromise in order to improve the reproduction of the sound for both listening positions, here the listening positions P1 and P2.

Figure 11:
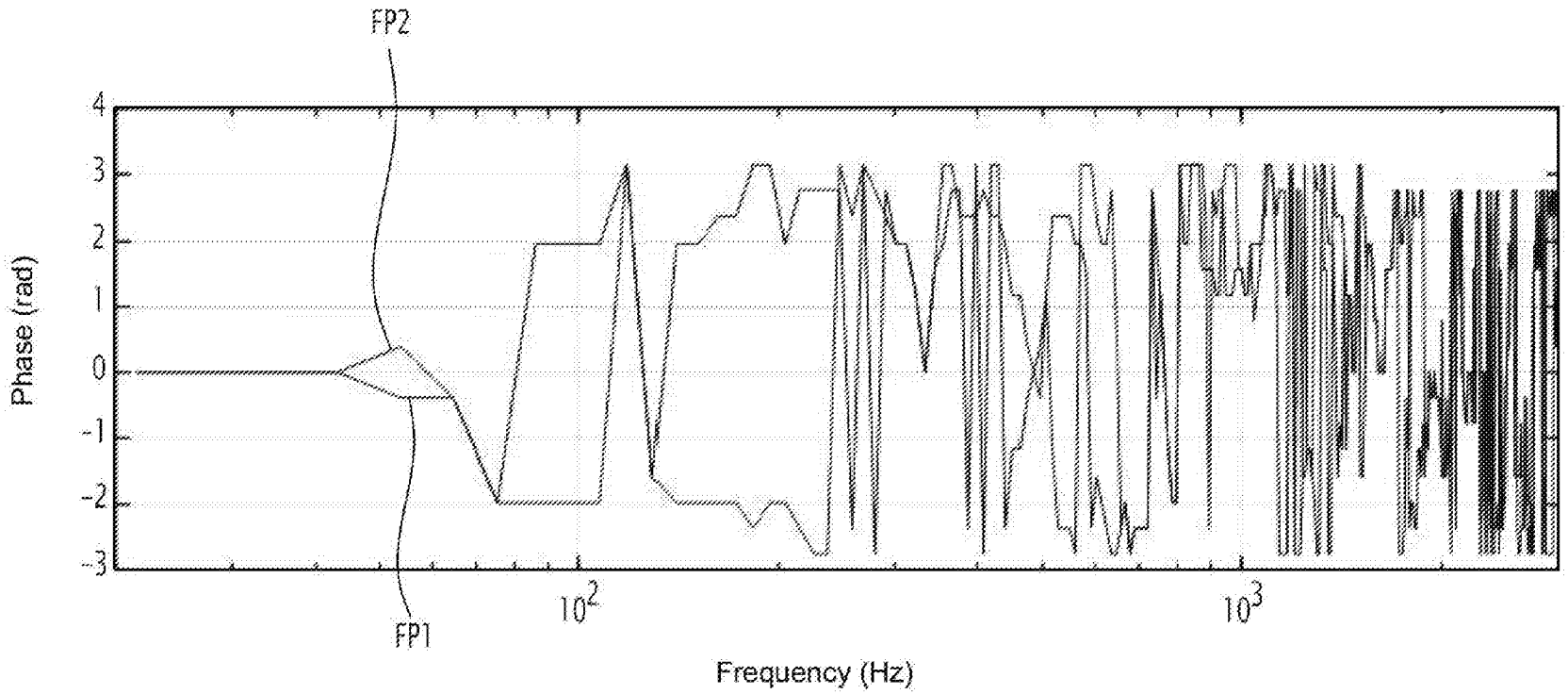
FIG. 11 is a graph similar to that of FIG. 8 illustrating two phase filters determined for two distinct listening positions.

FIG. 11 is a graph similar to that of FIG. 8 showing a first position phase filter FP1 determined for the first position P1 and a second position phase filter FP2 determined for the second position P2, each of the first position phase filter FP1 and the second position phase filter FP2 being determined by selecting, for each frequency, among the phase shift values used for the spectral measurements, the phase value procuring the highest acoustic pressure in the considered position.

According to one exemplary embodiment, a phase filter is determined as an average of the first position phase filter FP1 and the second position phase filter FP2.

According to this example embodiment, for each frequency f, the value of the phase filter F(f) is chosen as being equal to the value $(FP1(f)+FP2(f))/2$.

Alternatively, the phase filter is determined from the average of the acoustic pressures in the considered listening positions, here P1 and P2. The phase filter is then determined by selecting, for each frequency, among the phase shift values used for the spectral measurements, the phase shift value procuring the highest average acoustic pressure in the considered listening positions.

It will be noted that when, for a given frequency, the difference between the value of the first position phase filter FP1 and the value of the second position phase filter FP2 is greater than $\pi$, an offset is necessary to obtain a meaningful average value.

Figure 12:
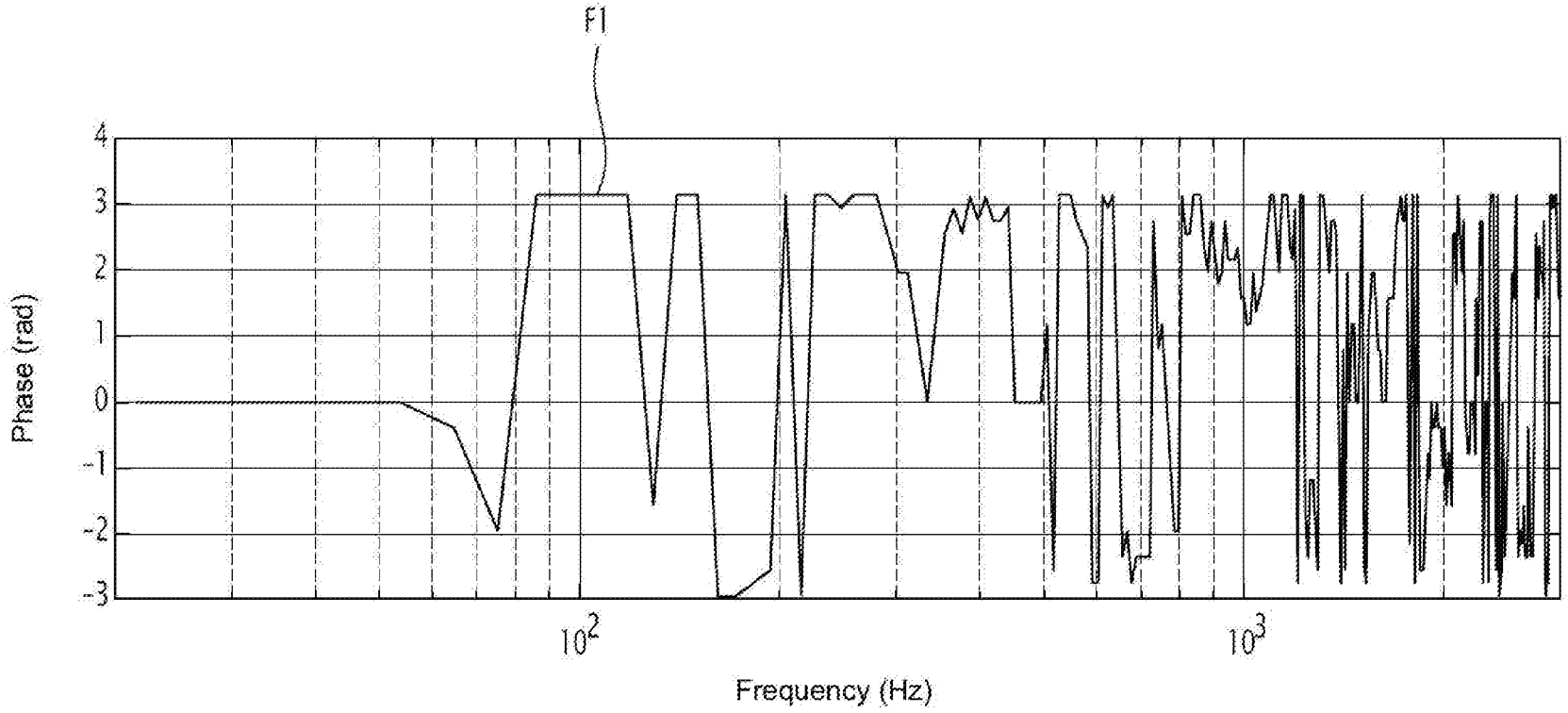
FIG. 12 is a similar graph illustrating a phase filter obtained as the average of the two phase filters of FIG. 11.

FIG. 12 is a graph illustrating a first phase filter F1 obtained as the average of the first position phase filter FP1 and the function of the second position phase filter FP2 of FIG. 11.

According to one exemplary embodiment, the determining method comprises determining a first phase filter and the unwrapping of the first phase filter and/or the smoothening of the first phase filter in order to obtain the phase filter suitable for being implemented in the filtering module 10 of the stereophonic system 2.

Figure 13:
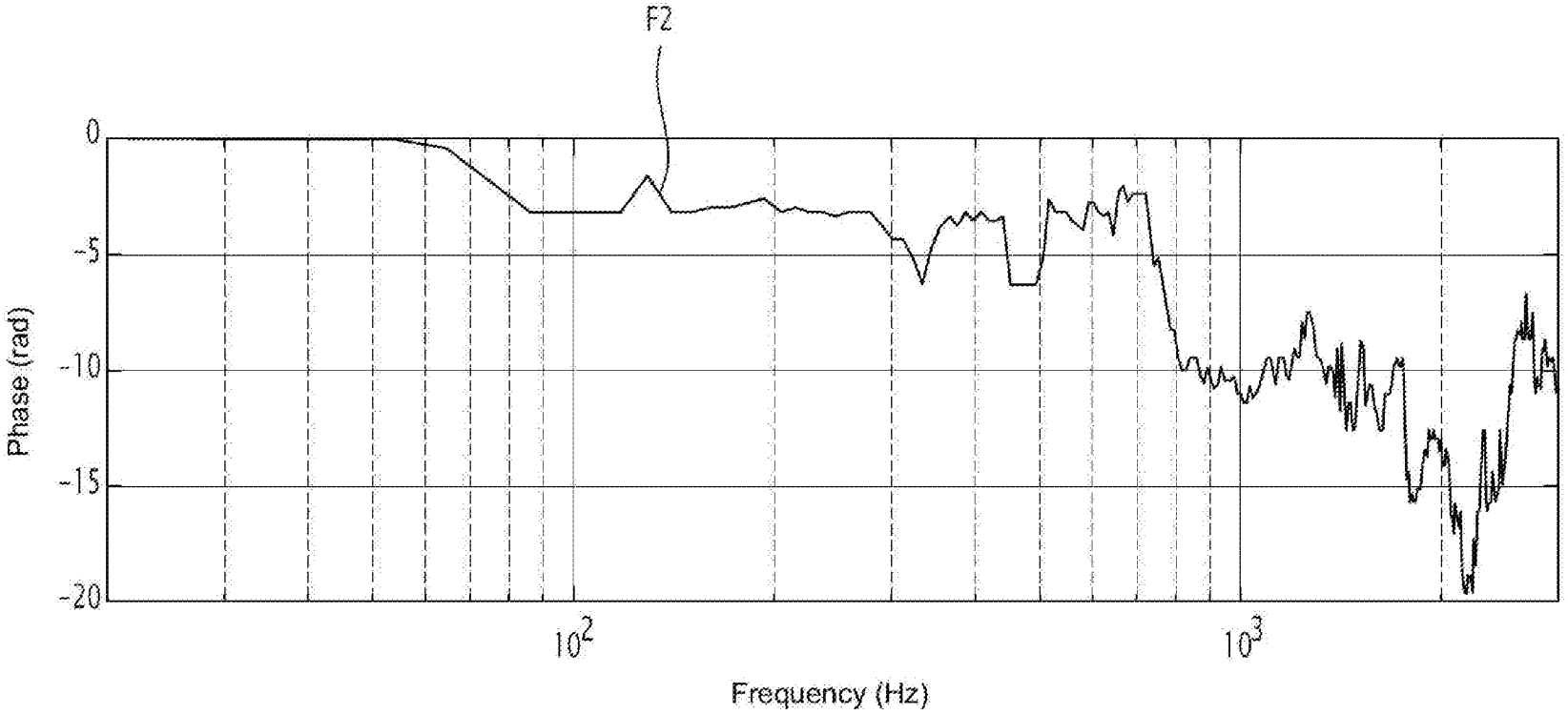
FIG. 13 is a graph illustrating a phase filter obtained by unwrapping of the phase filter of FIG. 12.

FIG. 13 is a graph showing the frequency on the x-axis and the phase shift on the y-axis, and showing a second phase filter F2 obtained by unwrapping the first phase filter F1 of FIG. 12.

The second phase filter F2 is usable as phase filter in the filtering module 10.

Figure 14:
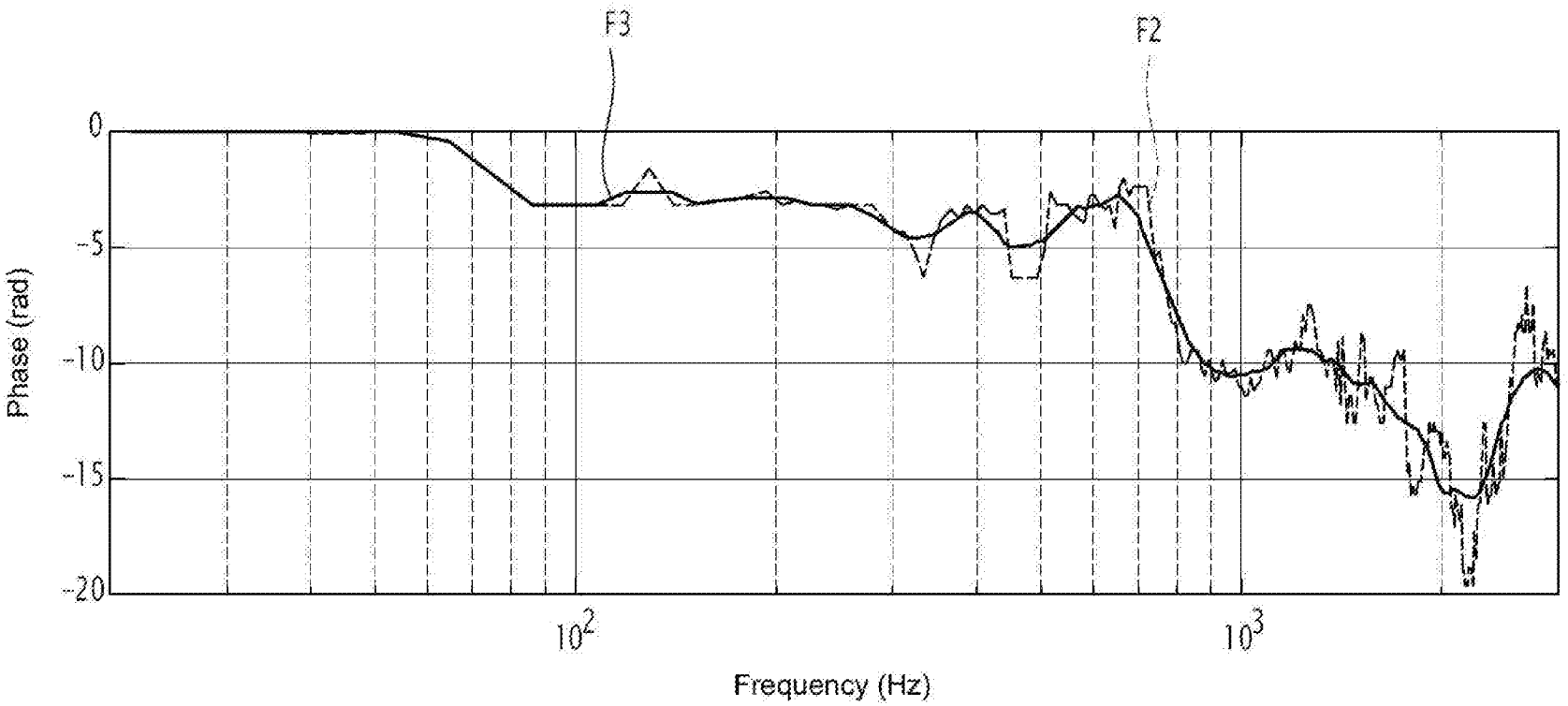
FIG. 14 is a graph illustrating a phase filter obtained by smoothening of the phase filter of FIG. 13.

FIG. 14 is a graph showing the frequency on the x-axis and the phase shift on the y-axis, and showing a third phase filter F3 obtained by smoothening the second phase filter F2 of FIG. 13.

The third phase filter F3 is usable in the filtering module 10.

A phase filter determined according to the exemplary embodiments of the determining method described above is usable to reproduce sounds using the stereophonic system 2, during the normal operation of the latter.

Thus, the invention generally relates to a method for reproducing sounds using a stereophonic system comprising a signal source configured to supply a first audio signal S1 and a second audio signal S2, a filtering module 10 configured for the relative phase shift of the first audio signal S1 and the second audio signal S2 by implementing a phase filter determined according to a determining method as defined above, and the broadcasting of the first audio signal S1 and the second audio signal S2 via a reproduction assembly 12 comprising at least one pair of electroacoustic transducers 14 comprising a first electroacoustic transducer 16 and a second electroacoustic transducer 18 respectively broadcasting the first audio signal S1 and the second audio signal S2 phase-shifted relative to one another by the filtering module 10.

It also relates to a stereophonic system configured to implement a phase filter determined according to the determining method described above.

Thus, the invention generally relates to a stereophonic system 2 comprising a signal source configured to supply a first audio signal S1 and a second audio signal S2, a filtering module 10 configured for the relative phase shift of the first audio signal S1 and the second audio signal S2 by implementing a phase filter determined according to a determining method as described above, and the broadcasting of the first audio signal S1 and the second audio signal S2 filtered by the filtering module 10 via a reproduction assembly 12 comprising at least one pair of electroacoustic transducers 14 comprising a first electroacoustic transducer 16 and a second electroacoustic transducer 18 respectively broadcasting the first audio signal S1 and the second audio signal (S2) phase-shifted relative to one another by the filtering module 10.

The filtering module 10 is for example a digital filter made by a software application able to be recorded in a computer memory and executable by a computer processor, by an application-specific integrated circuit (ASIC) or by a programmable logic circuit, for example a field programmable gate array (FPGA).

A programmable filtering module 10 facilitates the implementation of a phase filter determined according to the determining method.

In a variant, the filtering module 10 is an analog filtering module produced in the form of an electronic circuit formed by electronic components (resistance, capacitor, inductance, transistor, etc.).

Owing to the invention, it is possible to determine a phase filter making it possible to obtain a satisfactory sound reproduction, with an optimized acoustic pressure or according to a satisfactory compromise for all of the frequencies of the spectrum of the acoustic frequencies (that is to say, the frequencies that are perceptible by the human ear, that is to say, between about 20 Hz and 20 kHz).

The phase filter is determined from measurements done in situ, taking account of the surfaces of the space in which the stereophonic system 2 broadcasts sound, in particular the geometry of these surfaces and the nature of these surfaces, which can absorb sounds more or less.

The phase filter can be determined for a listening position or make a compromise for two listening positions.

The invention is not limited to stereophonic systems and to the determination of a phase filter making it possible to maximize the generated acoustic pressure in one or several listening positions.

Other exemplary embodiments and other variants can be considered.

In the described exemplary embodiments, the stereophonic system 2 comprises a single pair of electroacoustic transducers 14.

Of course, the determining method can be implemented with several pairs of electroacoustic transducers, as long as each pair of electroacoustic transducers has one electroacoustic transducer for broadcasting an audio signal of one channel of the audio source and another electroacoustic transducer for broadcasting the audio signal of the other channel of the audio source.

Furthermore, in the examples described above, the phase filter is determined so as to increase the acoustic pressure, that is to say, the amplitude of the vibrations.

In one variant, the determining method can be used to determine a transfer function making it possible to determine the acoustic pressure at least at one listening point.

The various examples and variants described to increase the acoustic pressure in at least one listening point are applicable similarly to decrease the acoustic pressure in said listening point.

For example, when said two listening points are considered and only the phase shift values 0 and π are used to perform two spectral measurements, criteria nos. 1 to 4 for choosing the phase shift for each frequency previously mentioned become the following:

the value π for each frequency for which a phase shift of π causes a decrease of the sound pressure for each listening position (P1, P2) (criterion no. 1);

the value 0 for each frequency for which a phase shift of π causes an increase of the sound pressure for each listening position (P1, P2) (criterion no. 2);

the value π for each frequency for which a phase shift of π causes a decrease of the sound pressure for one listening position without modifying the sound pressure for the other listening position substantially (criterion no. 3); and/or the value π for each frequency for which a phase shift of π causes a decrease of the sound pressure for one listening position above a decrease threshold, for example −3 dB, while causing an increase of the sound pressure for the other listening position below an increase threshold, for example +3 dB (criterion no. 4).

The other criteria for determining the phase filter and the other processing steps of the phase filter (unwrapping, smoothening, etc.) of course remain applicable.

When more than three spectral measurements are done for each listening position, the determining step of the phase filter comprises the selection, for each frequency and among the phase shift values used to perform the spectral measurements, of the phase shift value causing the weakest acoustic pressure at the considered listening position. The other steps of the phase filter (unwrapping, smoothening, etc.) remain applicable.

Furthermore, when several listening positions are taken into account, the phase filter can be determined as an average of a first position phase filter and a second position phase filter or from the average of the acoustic pressures in the considered listening positions by selecting, for each frequency, among the phase shift values used for the spectral measurements, the phase shift value procuring the lowest average acoustic pressure in the considered listening positions.

The decrease of the acoustic pressure in at least one listening point for example makes it possible to filter the audio signals in order to determine the sound amplitude in a listening point where a microphone 34 is located (FIG. 1).

Such a microphone 34 is for example used to record the voice of the user during the reproduction of sounds by the stereophonic system 2.

Such a recording is for example done during the user of a so-called "hands-free" function of a stereophonic system 2, during which the voice of the other person talking with the user via the telephone network is reproduced by the stereophonic system 2 and the voice of the user is recorded by the microphone 34 to be sent to the other person via the telephone network.

During the use of such a hands-free function, the voice of the other person reproduced by the stereophonic system 2 is recorded by the microphone 34 and sent back again to the other person through the telephone network, which generates an echo effect.

The minimization of the acoustic amplitude generated by the stereophonic system 2 at the point where the microphone 34 is located makes it possible to decrease this echo effect.

Similarly, certain vehicles are equipped with a voice command system allowing the user to control certain functions of the vehicle with the voice, and comprising a microphone 34 in order to detect the voice commands spoken by the user.

The voice command system can be disrupted when a stereophonic system 2 of the vehicle reproduces sounds.

The determination of the phase filter for decreasing the sound amplitude at the listening point corresponding to the position of the microphone 34 makes it possible to decrease these disruptions.

Applications to other types of sound reproduction systems are also possible.

For example, certain vehicle seats are provided with so-called "smart" headrests in particular incorporating speakers for broadcasting sounds near the head of the user seated on the seat. Such seats can for example be installed in car, a coach bus, an airplane, etc.

On such seats, due to design constraints, the speakers can be arranged asymmetrically relative to a median vertical plane passing through the theoretical position of the head of the user on the head rest.

As a result, the mono components of sounds broadcast by the speakers (that is to say, the components meant to be perceived by the user as being located in the center of the sound image) are off-centered.

The method for determining a phase filter according to the invention makes it possible to determine a phase filter making it possible to re-center the sound image of the mono components of sounds broadcast by such speakers.

To that end, the phase filter is determined so as to maximize the acoustic pressure in a listening position located in the median vertical plane passing through the theoretical position of the head of the user on the headrest for each frequency.

Furthermore, the invention is not limited to stereophonic systems and applies more generally to a system with several transducers in order to generate vibrations.

The vibrations are for example acoustic vibrations, like in the example of a stereophonic system, or vibrations of a solid, perceptible to the touch by the user or in turn able to generate acoustic vibrations perceptible by the user's hearing.

The vibrations are perceived by the user in at least one perception position, which for example corresponds to a listening position in the case of a sound reproduction system or a touch position in the case of vibrations of a solid perceptible to the touch.

Thus, the invention generally relates to a method for determining a phase filter of a system for generating vibrations comprising a signal source configured to deliver a first electrical signal and a second electrical signal, and a pair of transducers comprising a first transducer for converting the first electrical signal into vibrations perceptible by a user and a second transducer for converting the second electrical signal into vibrations perceptible by a user, the phase filter being provided to introduce a relative phase shift between the first electrical signal and the second electrical signal, the method comprising:

performing, for at least one determined perception position, of a plurality of spectral measurements of a characteristic parameter of the vibrations generated in this perception position as a function of the frequency, each spectral measurement being done for a respective phase shift value between the first electrical signal and the second electrical signal, and determining a phase filter from spectral measurements done, by selecting, for each frequency, a phase shift value from among the phase shift values used to perform the spectral measurements.

It also generally relates to a method for generating vibrations that are perceptible by a user using a system for generating vibrations comprising a source of electrical signals in order to supply a first electrical signal and a second electrical signal, a phase filter configured for the relative phase shift of the first electrical signal and the second electrical signal by implementing a transfer function determined according to a determining method as described above, and generating vibrations via at least one pair of transducers comprising a first transducer and a second transducer respectively converting the first electrical signal and the second electrical signal, phase-shifted relative to one another by the phase filter, into vibrations.

It also generally relates to a system for generating vibrations comprising a source of electrical signals in order to supply a first electrical signal and a second electrical signal, a filtering module implementing a phase filter determined according to a determining method as described above, and configured to introduce a relative phase shift between the first electrical signal and the second electrical signal, and at least one pair of transducers comprising a first transducer and a second transducer respectively receiving the first electrical signal and the second electrical signal, phase-shifted relative to one another by the phase filter.

The exemplary embodiments described for the stereophonic system apply similarly for a system for generating vibrations in general, in particular the embodiment variants with two spectral measurements or more than two spectral measurements, with application of criteria for selecting the phase shift value for each frequency, in particular with exactly two spectral measurements or more than two spectral measurements and/or with taking account of a perception position or several perception positions, for example by taking a phase filter average or a spectral measurement average.

Figure 15:
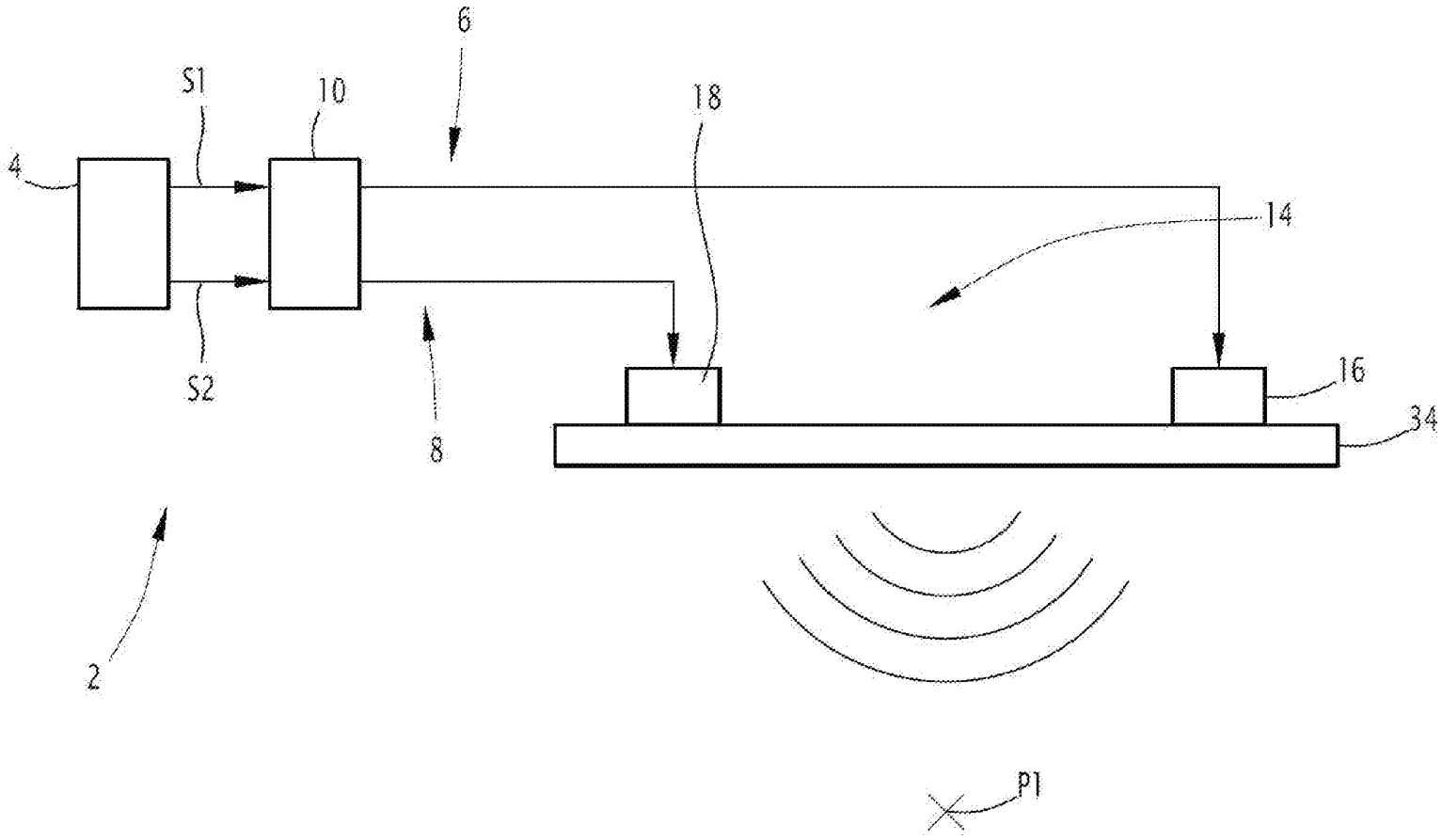
FIG. 15 is a schematic view of a system for generating sounds with acoustic panel.

According to an example illustrated in FIG. 15 in which the references to like elements have been retained, the method for determining a phase filter is usable to determine a phase filter of a filtering module 10 of a sound reproduction system 2 comprising an electrical signal source 4 in order to generate a first electrical signal S1 and a second electrical signal S2, a sound reproduction panel 36 and at least two separate transducers 16, 18 configured to generate mechanical vibrations in the sound reproduction panel 36 from electrical signals, each transducer 16, 18 being located in a respective position on the sound reproduction panel 36, the mechanical vibrations generated in the sound reproduction panel 36 by the transducers 16, 18 causing the emission of sounds by the sound reproduction panel 36.

The sound reproduction panel 36 is made from a rigid material, for example a lignocellulosic material, in particular plywood.

The phase shift of the electrical signals S1, S2 supplied to the transducers 16, 18 can affect the effectiveness of the broadcasting of the sound by the sound reproduction panel 36 and the directivity of the sounds emitted by the sound reproduction panel 36.

Thus, the determining method makes it possible to determine a phase filter making it possible to adjust the effectiveness and/or the directivity of sounds produced by a sound reproduction panel 36 provided with two transducers 16, 18.

In the previously mentioned examples, the method for determining a phase filter is applied to sound reproduction systems, that is to say, a system for generating acoustic vibrations.

Figure 16:
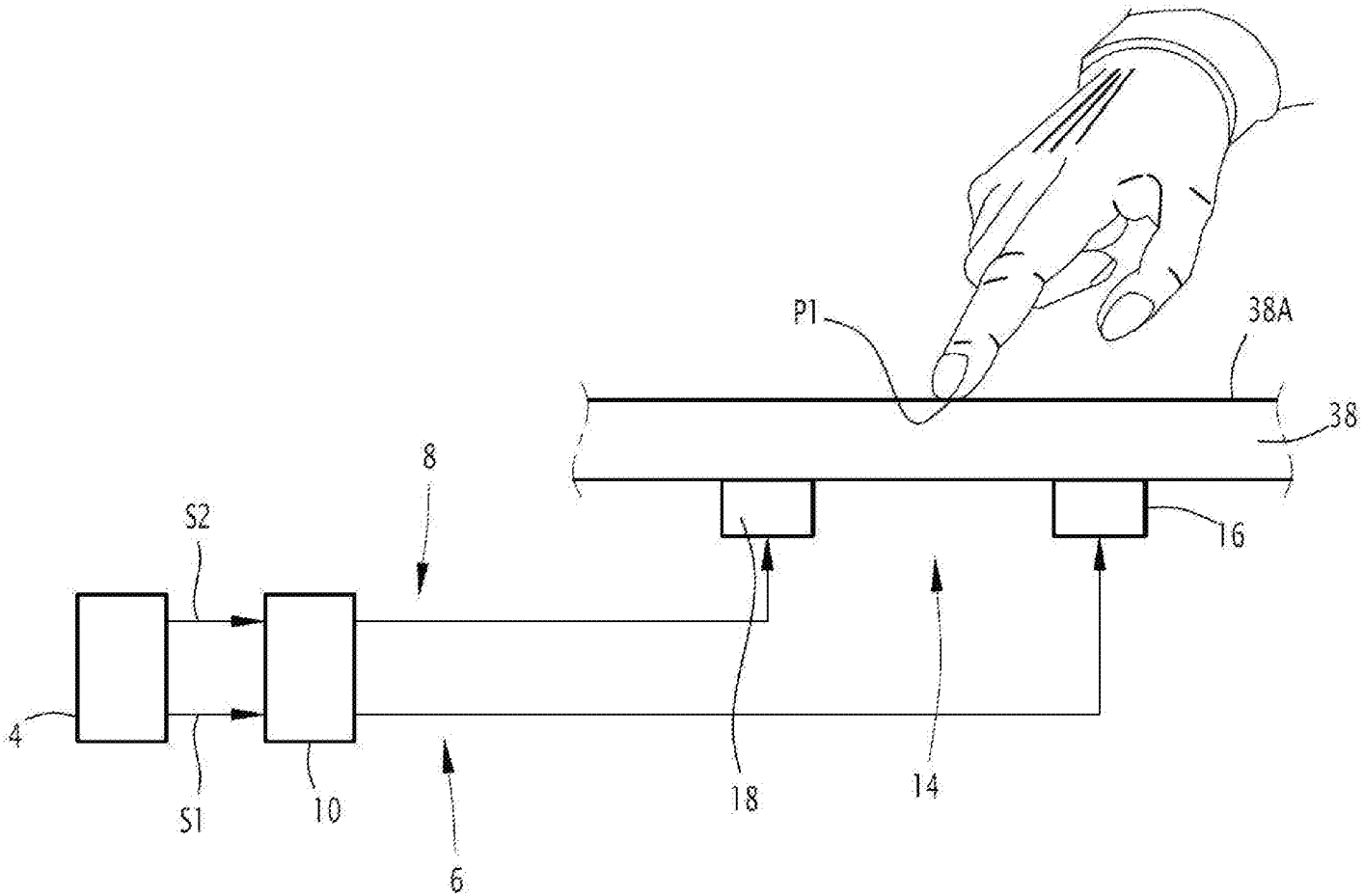
FIG. 16 is a schematic view of a system with haptic feedback.

According to an example illustrated in FIG. 16 in which the references to like elements have been retained, the method for determining a phase filter is applicable to a system for generating vibrations 2 in a solid 38, the vibrations being suitable for being perceived by touch by the user on a perception surface 38A of the solid 38, the system for generating vibrations 2 comprising at least two transducers 16, 18 arranged to generate vibrations in the solid 38 at two distinct points of the solid 38.

The system for generating vibrations 2 comprises a source of electrical signals 4 in order to supply a first electrical signal S1 and a second electrical signal S2, a filtering module 10 configured for the relative phase shift of the first electrical signal S1 and the second electrical signal S2 by implementing a phase filter determined according to a determining method according to the invention, and generating vibrations via at least one pair of transducers 14 comprising a first transducer 16 and a second transducer 18 respectively converting the first electrical signal S1 and the second electrical signal S2, phase-shifted relative to one another by the filtering module 10, into vibrations.

Such a system for generating vibrations 2 in a solid is for example a haptic feedback system making it possible to generate vibrations that are perceptible to the touch by a user in order to transmit tactile information to the user.

Such a system for generating vibrations 2 is for example integrated into a man-machine interface device, in order to generate haptic feedback on a tactile surface of the solid 38 allowing command entry by the user.

The man-machine interface device is for example a touch-sensitive screen, in particular a touch-sensitive screen of a personal computer, a digital tablet, a smartphone or a multimedia system of a motor vehicle.

In order to allow a better perception of the vibrations generated in the solid 38 at a determined perception point 40 of the solid 38, it is possible to phase shift the electrical signals S1, S2 supplied to the two transducers 16, 18 relative to one another so as to maximize the amplitude of the vibrations at the considered perception point 40.

The invention claimed is:

1. A method for determining a phase filter for a system for generating vibrations perceptible by a user comprising a signal source configured to deliver a first electrical signal and a second electrical signal, and a pair of transducers comprising a first transducer for converting the first electrical signal into vibrations perceptible by a user and a second transducer for converting the second electrical signal into vibrations perceptible by a user, the phase filter being provided to introduce a relative phase shift between the first electrical signal and the second electrical signal, the method comprising:

performing, for at least one determined perception position, a plurality of spectral measurements of a characteristic parameter of the vibrations generated in the at least one determined perception position as a function of the frequency, each spectral measurement being performed for a respective phase shift value between the first electrical signal and the second electrical signal, and determining a phase filter from the performed spectral measurements by selecting, for each frequency, a phase shift value from among the phase shift values used to perform the spectral measurements.

2. The determining method according to claim 1, wherein the step for performing spectral measurements comprises performing exactly two spectral measurements.

3. The determining method according to claim 2, wherein the phase shift values used for the two spectral measurements are 0 and $\pi$.

4. The determining method according to claim 3, comprising performing spectral measurements for two distinct perception positions and determining values assumed by the phase filter as a function of the frequency according to one or several of the following criteria:

the value $\pi$ for each frequency for which a phase shift of $\pi$ causes an increase of the characteristic parameter for each perception position;

the value 0 for each frequency for which a phase shift of $\pi$ causes a decrease of the characteristic parameter for each perception position;

the value $\pi$ for each frequency for which a phase shift of $\pi$ causes an increase of the characteristic parameter for one perception position without modifying the characteristic parameter for the other perception position significantly; and/or the value $\pi$ for each frequency for which a phase shift of $\pi$ causes, for a listening position, an increase above an increase threshold of the characteristic parameter while causing, for the other perception position, a decrease below a decrease threshold of the characteristic parameter.

5. The determining method according to claim 3, comprising performing spectral measurements for two distinct perception positions and determining values assumed by the phase filter as a function of the frequency according to one or several of the following criteria:

the value $\pi$ for each frequency for which a phase shift of $\pi$ causes a decrease of the characteristic parameter for each perception position;

the value 0 for each frequency for which a phase shift of $\pi$ causes an increase of the characteristic parameter for each perception position;

the value $\pi$ for each frequency for which a phase shift of $\pi$ causes a decrease of the characteristic parameter for one perception position without modifying the characteristic parameter for the other perception position significantly; and/or the value $\pi$ for each frequency for which a phase shift of $\pi$ causes, for a listening position, a decrease above a decrease threshold of the characteristic parameter while causing, for the other perception position, an increase below an increase threshold of the characteristic parameter.

6. The determining method according to claim 5, wherein the value of the phase difference between two transducers is chosen to be equal to the value of $+\pi/2$ or $-\pi/2$ for each frequency for which none of the criteria are applicable.

7. The determining method according to claim 2, wherein the phase filter is determined by taking a phase shift of $\pi$ for the frequencies for which a phase shift of $\pi$ causes an increase, respectively a decrease, of the characteristic parameter, a nil phase shift for the frequencies for which a phase shift of $\pi$ causes a decrease, respectively an increase, of the characteristic parameter, and a nil phase shift for the other frequencies.

8. The determining method according to claim 1, wherein the spectral measurements are performed for each perception position with a series of phase shift values with a regular interval between the phase shift values.

9. The determining method according to claim 8, wherein the spectral measurements are performed successively by varying the phase shift incrementally between the successive spectral measurements.

10. The determining method according to claim 8, wherein the step for performing spectral measurements comprises performing N measurements for each perception position, with an interval of $2\pi/N$ between the phase shift values, N being a real number.

11. The determining method according to claim 1, wherein the determination of the phase filter comprises the determination of the first phase filter, and the unwrapping and/or smoothening of the first phase filter.

12. The determining method according to claim 1, wherein the step for performing spectral measurements comprises performing spectral measurements for several distinct perception positions, and the step for determining the phase filter comprises determining a phase filter as an average of phase filters associated with the different perception positions.

13. The determining method according to claim 1, wherein the step for performing spectral measurements comprises performing spectral measurements for several distinct perception positions, and the determining step comprises determining a phase filter from the average of the spectral measurements associated with the different perception positions.

14. The determining method according to claim 1, wherein the characteristic parameter is the amplitude of the vibrations.

15. The determining method according to claim 1, wherein the vibrations are sound vibrations, the first transducer and the second transducer being electroacoustic transducers.

16. The determining method according to claim 1, wherein the vibrations are mechanical vibrations of a solid that are perceptible to the touch and/or capable of generating acoustic waves due to the vibrations of the solid.

17. A method for generating vibrations that are perceptible by a user using a system for generating vibrations comprising a source of electrical signals for generating a first electrical signal and a second electrical signal, a filtering module for filtering the first electrical signal and the second electrical signal, and at least one pair of transducers, the method comprising:

determining a phase filter using the method of claim 1;

generating by the source of electrical signals the first electrical signal and the second electrical signal;

performing by the filtering module a relative phase shift of the first electrical signal and the second electrical signal using the phase filter; and generating vibrations via the at least one pair of transducers comprising a first transducer and a second transducer by converting the relatively phase shifted first and second electrical signals into vibrations.

18. A method for reproducing sounds using a stereophonic system comprising a signal source, a filtering module, and a broadcasting assembly having at least one pair of electroacoustic transducers comprising a first electroacoustic transducer and a second electroacoustic transducer, the method comprising:

determining a phase filter using the method of claim 1;

generating by the signal source a first audio signal and a second audio signal;

performing by the filtering module a relative phase shift of the first audio signal and the second audio signal using the phase filter; and broadcasting the first audio signal and the second audio signal filtered by the phase filter via the at least one pair of electroacoustic transducers, the first electroacoustic transducer and the second electroacoustic transducer respectively broadcasting the first audio signal and the second audio signal being phase-shifted relative to one another by the phase filter.

19. A system for generating vibrations comprising:

a source of electrical signals configured to generate a first electrical signal and a second electrical signal;

a filtering module configured as a phase filter to phase shift between the first audio signal relative to the second audio signal;

a determining assembly that determines the phase filter of the filtering mechanism using the method of claim 1; and at least one pair of transducers comprising a first transducer and a second transducer for respectively converting the first electrical signal and the second electrical signal, phase-shifted relative to one another by the phase filter, into vibrations.

20. A stereophonic system comprising:

a signal source configured to generate a first electrical audio signal and a second electrical audio signal;

a filtering module configured as a phase filter to phase shift the first audio signal relative to the second audio signal;

a determining assembly that determines the phase filter of the filtering mechanism using the method of claim 1; and a broadcasting assembly comprising at least one pair of electroacoustic transducers comprising a first electroacoustic transducer and a second electroacoustic transducer for respectively broadcasting the first audio signal and the second audio signal phase-shifted relative to one another by the phase filter.

* * * * *